US010451985B2

(12) United States Patent
Takahashi et al.

(10) Patent No.: US 10,451,985 B2
(45) Date of Patent: Oct. 22, 2019

(54) TONER

(71) Applicant: CANON KABUSHIKI KAISHA, Tokyo (JP)

(72) Inventors: Toru Takahashi, Toride (JP); Hiroki Watanabe, Matsudo (JP); Yoshihiro Ogawa, Toride (JP); Daisuke Tsujimoto, Tokyo (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/902,057

(22) Filed: Feb. 22, 2018

(65) Prior Publication Data

US 2018/0246429 A1 Aug. 30, 2018

(30) Foreign Application Priority Data

Feb. 28, 2017 (JP) ..... 2017-035822
Jan. 29, 2018 (JP) ..... 2018-012641

(51) Int. Cl.
*G03G 9/08* (2006.01)
*G03G 9/097* (2006.01)
*G03G 9/107* (2006.01)

(52) U.S. Cl.
CPC ..... *G03G 9/0819* (2013.01); *G03G 9/09708* (2013.01); *G03G 9/09716* (2013.01); *G03G 9/107* (2013.01)

(58) Field of Classification Search
CPC ..... G03G 9/097; G03G 9/09708
See application file for complete search history.

(56) References Cited

U.S. PATENT DOCUMENTS 5,437,949 A 8/1995 Kanbayashi et al.
5,607,806 A 3/1997 Kanbayashi et al.
5,635,326 A 6/1997 Kanbayashi et al.
5,670,288 A 9/1997 Okado et al.
5,700,617 A 12/1997 Takiguchi et al.
5,747,209 A 5/1998 Takiguchi et al.
5,750,302 A 5/1998 Ogawa et al.
5,851,714 A 12/1998 Taya et al.
5,858,593 A 1/1999 Tamura et al.
5,912,099 A 6/1999 Kanbayashi et al.
5,922,500 A 7/1999 Iida et al.
5,976,752 A 11/1999 Matsunaga et al.
5,994,018 A 11/1999 Iida et al.
6,013,402 A 1/2000 Kanbayashi et al.
6,022,659 A 2/2000 Kanbayashi et al.
6,060,202 A 5/2000 Ogawa et al.
6,077,635 A 6/2000 Okado et al.
6,238,834 B1 5/2001 Tamura et al.
6,326,114 B1 12/2001 Itakura et al.
6,426,169 B1 7/2002 Onuma et al.
6,485,875 B1 11/2002 Karaki et al.
6,528,222 B2 3/2003 Kohtaki et al.
6,586,147 B2 7/2003 Iida et al.
6,664,016 B2 12/2003 Kanbayashi et al.
6,751,424 B2 6/2004 Komatsu et al.
6,808,852 B2 10/2004 Hotta et al.
6,875,549 B2 4/2005 Yamazaki et al.
6,881,527 B2 4/2005 Moribe et al.
7,115,349 B2 10/2006 Iida et al.
7,147,980 B2 12/2006 Itakura et al.
7,267,919 B2 9/2007 Moribe et al.
7,368,211 B2 5/2008 Hasegawa et al.
7,402,368 B2 7/2008 Ogawa et al.
7,422,832 B2 9/2008 Ogawa et al.
7,455,947 B2 11/2008 Ida et al.
7,470,494 B2 12/2008 Nishiyama et al.
7,582,401 B2 9/2009 Ogawa et al.
7,678,524 B2 3/2010 Hasegawa et al.
7,704,659 B2 4/2010 Ogawa et al.
7,811,734 B2 10/2010 Ogawa et al.
7,816,063 B2 10/2010 Hashimoto et al.
7,855,042 B2 12/2010 Kobori et al.
7,939,231 B2 5/2011 Ogawa et al.
8,084,174 B2 12/2011 Hasegawa et al.
8,124,306 B2 2/2012 Hirata et al.
8,501,377 B2 8/2013 Takahashi et al.
8,512,925 B2 8/2013 Moribe et al.
8,530,129 B2 * 9/2013 Hama ..... G03G 5/005 430/108.1
9,097,998 B2 8/2015 Yamazaki et al.
9,128,400 B2 9/2015 Takahashi et al.
9,158,217 B2 10/2015 Takahashi et al.
9,239,528 B2 * 1/2016 Hasegawa ..... G03G 9/08

(Continued)

FOREIGN PATENT DOCUMENTS

JP 2006-195156 7/2006
JP 2009-063616 3/2009

(Continued)

OTHER PUBLICATIONS

U.S. Appl. No. 15/889,500, filed Feb. 6, 2018, Nobuyoshi Sugahara.

*Primary Examiner* — Thorl Chea
(74) *Attorney, Agent, or Firm* — Venable LLP

(57) ABSTRACT

A toner comprising a toner particle, and strontium titanate, wherein the strontium titanate has a specific number average particle diameter, the strontium titanate has a maximum peak (a) at a diffraction angle (2θ) of 32.00 deg to 32.40 deg in CuKα characteristic X-ray diffraction, the half width of the maximum peak (a) is 0.23 deg to 0.50 deg, an intensity (Ia) of the maximum peak (a) and a maximum peak intensity (Ix) in a range of a diffraction angle (2θ) of 24.00 deg to 28.00 deg satisfy a specific relationship, the content of strontium oxide and titanium oxide in the strontium titanate is at least 98.0% by mass, and a sum total Et of a rotational torque and a vertical load in powder flowability analysis of the toner is 100 mJ to 2000 mJ.

3 Claims, 2 Drawing Sheets

(56) References Cited

U.S. PATENT DOCUMENTS

| | | | | |
|---|---|---|---|---|
| 9,454,094 | B2 | 9/2016 | Tsujimoto et al. | |
| 9,500,975 | B2 | 11/2016 | Sugahara et al. | |
| 9,599,920 | B2 | 3/2017 | Sugahara et al. | |
| 9,606,466 | B2 | 3/2017 | Takahashi et al. | |
| 9,703,216 | B2 | 7/2017 | Tsuchida et al. | |
| 9,778,598 | B2 | 10/2017 | Onozaki et al. | |
| 9,785,070 | B2 | 10/2017 | Sugahara et al. | |
| 2002/0055053 | A1 | 5/2002 | Kasuya et al. | |
| 2004/0110076 | A1 | 6/2004 | Yamazaki et al. | |
| 2013/0252167 | A1 | 9/2013 | Moribe et al. | |
| 2013/0309603 | A1 | 11/2013 | Takahashi et al. | |
| 2014/0004460 | A1 | 1/2014 | Yoshiba et al. | |
| 2015/0086917 | A1* | 3/2015 | Iwasaki ..... | G03G 9/09716 430/106.1 |
| 2016/0306301 | A1 | 10/2016 | Sugahara et al. | |
| 2017/0023873 | A1* | 1/2017 | Fujisaki ..... | G03G 9/08726 |
| 2017/0227866 | A1 | 8/2017 | Sugahara et al. | |

FOREIGN PATENT DOCUMENTS

| | | |
|---|---|---|
| JP | 4799567 | 10/2011 |
| JP | 4979517 | 7/2012 |
| JP | 2016-110095 | 6/2016 |
| WO | 2007/078002 | 7/2007 |

* cited by examiner

TONER

BACKGROUND OF THE INVENTION

Field of the Invention

The present invention relates to a toner used in an image forming method and a toner jet system for visualizing an electrophotography and an electrostatic image.

Description of the Related Art

As image forming apparatuses such as copying machines and printers have become widespread in recent years, higher image quality is needed, in addition to higher speed and longer life, as a performance feature required for image forming apparatuses.

Reduction in toner particle diameter has been advanced as means for achieving high image quality in the image forming apparatuses. As the particle diameter of the toner becomes smaller, dot reproducibility and fine line reproducibility are improved, but the flowability and charging performance of the toner are likely to be non-uniform.

In particular, when a large number of images of the same pattern are printed, the charging performance and flowability of the toner on the developing sleeve tend to be non-uniform in a printed portion and a non-printed portion. In some cases, where different images are continuously printed while the charging performance and flowability of the toner remain non-uniform, the history of the previous image can be reflected as a difference in a printed image density (hereinafter referred to as "sleeve ghost").

For example, Japanese Patent Application Publication No. 2016-110095 discloses a technique capable of controlling the toner charging performance and flowability and suppressing a sleeve ghost under a low-temperature and low-humidity environment by adding silica having a number average particle diameter of at least 5 nm and not more than 20 nm and silica having a number average particle diameter of at least 80 nm and not more than 200 nm to a toner.

Yet another problem is that when the charge quantity distribution of the toner on the developing sleeve is broad, in particular when the toner is used over a long period of time under a high-temperature and high-humidity environment, the toner having a low charge quantity is accumulated in the developing device, fine line reproducibility and dot reproducibility are deteriorated, and quality of a fine image may be deteriorated.

Meanwhile, when the particle diameter of the toner becomes small, the toner is unlikely to be scraped by the cleaning blade in the cleaning step, and the toner easily passes through the cleaning blade. In other words, the so-called cleaning defects are likely to occur.

A method of adding strontium titanate to a toner particle has been known as a measure against cleaning defects. For example, Japanese Patent Application Publication No. 2006-195156 discloses a technique for preventing cleaning defects by using a toner including strontium titanate having a number average particle diameter of at least 80 nm and not more than 220 nm and strontium titanate having a number average particle diameter of at least 300 nm and not more than 3000 nm.

Further, Japanese Patent No. 4799567 discloses a technique for preventing cleaning defects by using a toner including composite inorganic fine powder including strontium titanate having a half width of an X-ray diffraction peak at 32.20 deg of 0.20 to 0.30 deg.

Furthermore, Japanese Patent No. 4979517 discloses a technique for improving transferability by using a toner including a composite oxide including strontium titanate having a half width of an X-ray diffraction peak at 32.20 deg of 0.20 to 0.30 deg.

SUMMARY OF THE INVENTION

However, in the invention of Japanese Patent Application Publication No. 2016-110095, further improvement is required against a sleeve ghost under a high-temperature and high-humidity environment.

Also, in the toner of Japanese Patent Application Publication No. 2006-195156, there is a certain effect in suppressing the cleaning defects. However, as a result of investigation by the present inventors, it has been found that when an image with a high print percentage is continuously printed in a low-temperature and low-humidity environment by using a toner including strontium titanate having a particle diameter of at least 300 nm, aggregates of the strontium titanate and the toner are likely to appear inside the developing device. As a result, it has been found that high abrasive property of strontium titanate causes so-called white streaks which are scraped portions of sleeve surface where no printing is performed, and further improvement is therefore essential.

Further, in the toners disclosed in Japanese Patents No. 4799567 and No. 4979517, further improvement is required against a sleeve ghost.

The present invention is created to solve the above problems, and it is an object of the present invention to provide a toner which is unlikely to cause the sleeve ghost even when used in a high-temperature and high-humidity environment or a low-temperature and low-humidity environment and which excels in fine line reproducibility and dot reproducibility even when used over a long period in a high-temperature and high-humidity environment.

It is another object of the present invention to provide a toner capable of suppressing cleaning defects of a photosensitive member and also suppressing white streaks and sleeve ghosts even when used in a high-temperature and high-humidity environment or a low-temperature and low-humidity environment.

According to a first aspect of the present invention, there is provided a toner characterized by including a toner particle, and strontium titanate, wherein a number average particle diameter of primary particles of the strontium titanate is at least 10 nm and not more than 95 nm;

the strontium titanate has a maximum peak (a) at a diffraction angle (2θ) of at least 32.00 deg and not more than 32.40 deg in CuKα characteristic X-ray diffraction;

a half width of the maximum peak (a) is at least 0.23 deg and not more than 0.50 deg;

an intensity (Ia) of the maximum peak (a) and a maximum peak intensity (Ix) in a range of a diffraction angle (2θ) of at least 24.00 deg and not more than 28.00 deg in CuKα characteristic X-ray diffraction satisfy the following Formula (1):

$$(Ix)/(Ia) \leq 0.010 \quad (1);$$

the strontium titanate is such that, when all elements detected by X-ray fluorescence analysis of the strontium titanate are considered to be in the form of oxides and when a total amount of all the oxides is taken as 100% by mass, a total content of strontium oxide and titanium oxide is at least 98.0% by mass; and a sum total Et of a rotational torque and a vertical load, which is obtained when, in powder flowability analysis of the toner, a propeller-type blade is vertically introduced into a powder layer of the toner in a measurement container while being rotated at a periphery speed of the outermost edge portion thereof at 100 mm/sec, measurement is started from a position of 100 mm from a bottom surface of the powder layer, and the propeller-type blade is introduced to a position of 10 mm from the bottom surface, is at least 100 mJ and not more than 2000 mJ.

According to a second aspect of the present invention, there is provided a toner characterized by including a toner particle, inorganic fine particles A, and inorganic fine particles B, wherein a weight average particle diameter (D4) of the toner is at least 3.0 μm and not more than 10.0 μm;

the inorganic fine particles A and the inorganic fine particles B are strontium titanate;

a number average particle diameter of primary particles of the inorganic fine particles A is at least 10 nm and not more than 95 nm;

the inorganic fine particles A have a maximum peak (a) at a diffraction angle (2θ) of at least 32.00 deg and not more than 32.40 deg in CuKα characteristic X-ray diffraction;

a half width of the maximum peak (a) is at least 0.23 deg and not more than 0.50 deg;

the inorganic fine particles A have a water adsorption amount of at least 1 mg/g and not more than 40 mg/g at a relative humidity of 80% in a water adsorption isotherm at 30° C.; and a number average particle diameter of primary particles of the inorganic fine particles B is at least 500 nm and not more than 2000 nm.

According to the first aspect of the present invention, it is possible to provide a toner which is unlikely to cause a sleeve ghost even when used in a high-temperature and high-humidity environment or a low-temperature and low-humidity environment and which excels in fine line reproducibility and dot reproducibility even when used over a long period in a high-temperature and high-humidity environment.

According to the second aspect of the present invention, it is possible to provide a toner capable of suppressing cleaning defects of a photosensitive member and also suppressing white streaks and sleeve ghosts even when used in a high-temperature and high-humidity environment or a low-temperature and low-humidity environment.

Further features of the present invention will become apparent from the following description of exemplary embodiments with reference to the attached drawings.

DESCRIPTION OF THE EMBODIMENTS

Figure 1:
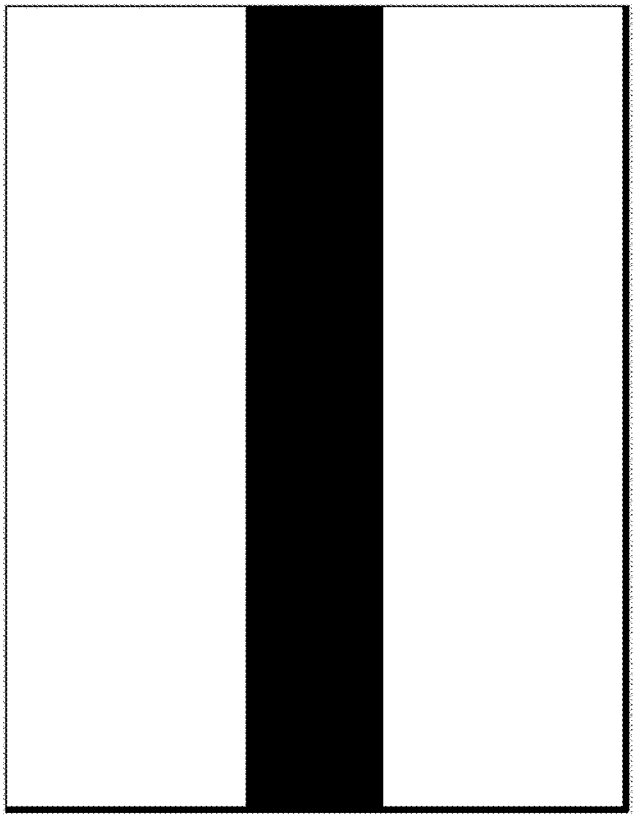
FIG. 1 is an example of a pattern image for evaluating a sleeve ghost.

In the present invention, the expression "at least OO and not more than XX" and "OO to XX" representing a numerical range means a numerical range including a lower limit and an upper limit which are endpoints, unless otherwise specified.

First Aspect

Hereinafter, the first aspect of the present invention will be described in detail.

According to the first aspect, there is provided a toner characterized by including toner particles and strontium titanate, wherein a number average particle diameter of primary particles of the strontium titanate is at least 10 nm and not more than 95 nm;

the strontium titanate has a maximum peak (a) at a diffraction angle (2θ) of at least 32.00 deg and not more than 32.40 deg in CuKα characteristic X-ray diffraction;

a half width of the maximum peak (a) is at least 0.23 deg and not more than 0.50 deg;

an intensity (Ia) of the maximum peak (a) and a maximum peak intensity (Ix) in a range of a diffraction angle (2θ) of at least 24.00 deg and not more than 28.00 deg in CuKα characteristic X-ray diffraction satisfy the following Formula (1):

$$(Ix)/(Ia) \leq 0.010 \ldots \quad (1);$$

the strontium titanate is such that, when all elements detected by X-ray fluorescence analysis of the strontium titanate are considered to be in the form of oxides and when a total amount of all the oxides is taken as 100% by mass, a total content of strontium oxide and titanium oxide is at least 98.0% by mass; and a sum total Et of a rotational torque and a vertical load, which is obtained when, in powder flowability analysis of the toner, a propeller-type blade is vertically introduced into a powder layer of the toner in a measurement container while being rotated at a periphery speed of the outermost edge portion thereof at 100 mm/sec, measurement is started from a position of 100 mm from a bottom surface of the powder layer, and the propeller-type blade is introduced to a position of 10 mm from the bottom surface, is at least 100 mJ and not more than 2000 mJ.

The abovementioned toner is unlikely to cause a sleeve ghost even when used in a high-temperature and high-humidity environment or a low-temperature and low-humidity environment and excels in fine line reproducibility and dot reproducibility even when used over a long period in a high-temperature and high-humidity environment.

The reason why the abovementioned features make it possible to demonstrate the excellent effects which could not be heretofore obtained is considered hereinbelow.

In the present invention, the strontium titanate is characterized by having a maximum peak (a) at a diffraction angle (2θ) of at least 32.00 deg and not more than 32.40 deg in CuKα characteristic X-ray diffraction, and a half width of the maximum peak (a) being at least 0.23 deg and not more than 0.50 deg. The maximum peak (a) is attributable to the (1,1,0) plane peak of a strontium titanate crystal.

As a result of intensive research, the inventors of the present invention have found that it is very important to control the half width to at least 0.23 deg and not more than 0.50 deg.

Generally, the half width of the diffraction peak in X-ray diffraction is related to the crystallite size of strontium titanate. One primary particle is constituted by a plurality of crystallites, and the crystallite size is the size of each crystallite constituting the primary particle.

In the present invention, the term "crystallite" refers to individual crystal grains constituting a particle, and the crystallites collect into a particle. Crystallite size and particle size are unrelated to each other. Where the crystallite size of strontium titanate is small, the half width becomes large, and where the crystallite size of strontium titanate is large, the half width decreases.

The half width of the diffraction peak in the X-ray diffraction of the strontium titanate of the present invention is at least 0.23 deg and not more than 0.50 deg, which means that the crystallite size is smaller than that of the conventional strontium titanate.

As the crystallite size of strontium titanate decreases, grain boundaries (crystal grain boundaries) of crystallites present in primary particles increase. The crystal grain boundary is considered to be a location where electric charges are trapped. Therefore, when the charge quantity of the toner is small, since grain boundaries are likely to trap electric charges, the rise of the triboelectric charge quantity of the toner is accelerated. Meanwhile, since the interior of the crystallites of strontium titanate easily leaks the electric charge of the toner, it is conceivable that when the toner is excessively charged and the charge quantity that can be trapped by the crystal grain boundaries is exceeded, electric charges pass through the interior of the crystallite and excessive charging of the toner can be suppressed.

Thus, by controlling the half width to at least 0.23 deg and not more than 0.50 deg, it is possible to obtain the effect of accelerating the rise of charging of the toner and suppressing the excessive charging of the toner which cannot be obtained with the conventional strontium titanate. As a result, even when a large number of images of the same pattern are printed, it is possible to maintain uniform charging performance of the toner in the printed portion and non-printed portion on the developing sleeve. Therefore, it is conceivable that the effect of suppressing the sleeve ghost is dramatically enhanced even when the toner is used in a high-temperature and high-humidity environment or a low-temperature and low-humidity environment.

Further, where the effect of accelerating the rise of charging of the toner on the developing sleeve and suppressing the excessive charging is improved, the charge quantity distribution of the toner becomes sharper. When the toner charge quantity distribution is broad, especially when the toner is used over a long period of time in a high-temperature and high-humidity environment, the toner with a low charge quantity accumulates in the developing unit, fine line reproducibility and dot reproducibility deteriorate, and image quality of fine images may be degraded.

In the present invention, since the effect of accelerating the rise of charging of the toner and suppressing the excessive charging is satisfactory, it is possible to provide a toner which has a sharp charge quantity distribution of the toner and demonstrates satisfactory fine line reproducibility and dot reproducibility even when used over a long period in a high-temperature and high-humidity environment.

In the present invention, it is important that the half width of the diffraction peak in X-ray diffraction of strontium titanate be at least 0.23 deg and not more than 0.50 deg, preferably at least 0.25 deg and not more than 0.45 deg, and more preferably at least 0.28 deg and not more than 0.40 deg. Within the above ranges, the sleeve ghosts are better prevented even when the toner is used in a high-temperature and high-humidity environment or a low-temperature and low-humidity environment, and fine line reproducibility and dot reproducibility of the toner are satisfactory even when the toner is used over a long period in a high-temperature and high-humidity environment.

In the present invention, it is important that the intensity (Ia) of the maximum peak (a) and the maximum peak intensity (Ix) in a range of a diffraction angle (2θ) of at least 24.00 deg and not more than 28.00 deg in CuKα characteristic X-ray diffraction satisfy the following Formula (1):

$$(Ix)/(Ia) \leq 0.010 \ldots \quad (1).$$

Here, (Ix) represents the peaks of $SrCO_3$ and $TiO_2$ derived from the raw material of strontium titanate.

When (Ix)/(Ia) does not satisfy the Formula (1), it means that the purity of strontium titanate is low. For example, when $SrCO_3$ and $TiO_2$ derived from the raw material of strontium titanate remain as impurities, the maximum peak intensity (Ix) thereof becomes large, and the Formula (1) is not satisfied. In this case, the impurities tend to localize at the crystal grain boundaries, and electric charges are not trapped at the crystal grain boundaries and are likely to leak. Therefore, the rise of charging is decelerated.

Meanwhile, where the Formula (1) is satisfied, since the purity of strontium titanate is high and only few impurities are localized at the crystal grain boundaries, electric charges are likely to be trapped at the crystal grain boundaries, and the rise of charging is accelerated. As a result, sleeve ghosts are unlikely to occur even when the toner is used in a high-temperature and high-humidity environment, and fine line reproducibility and dot reproducibility are improved even when the toner is used over a long period in a high-temperature and high-humidity environment.

It is important that the Formula (1) be (Ix)/(Ia)≤0.010, and preferably (Ix)/(Ia)≤0.008. It is preferable that there be no peak of (Ix) derived from impurities.

The ratio (Ix)/(Ia) can be controlled by the mixing ratio of a titanium raw material and a strontium raw material, a reaction temperature, and a reaction time. Furthermore, the ratio can be controlled by acid washing the strontium titanate slurry after the reaction.

In the present invention, it is important that the strontium titanate be such that, when all elements detected by X-ray fluorescence analysis of the strontium titanate are considered to be in the form of oxides and when a total amount of all oxides is taken as 100% by mass, a total content of strontium oxide and titanium oxide is at least 98.0% by mass.

When the aforementioned content is less than 98.0% by mass, it means that a large number of impurities other than strontium titanate are contained inside the crystal. When a large number of impurities are inside the crystals of strontium titanate, the impurities distort the crystals, and due to this effect, the half width increases. In this case, although it is possible to increase the half width, it is difficult to control the crystallite size to be small, so that crystal grain boundaries are reduced in size and electric charges tend to leak. Therefore, the rise of charging is decelerated. By setting the content of strontium oxide and titanium oxide to at least 98.0% by mass, the crystallite size of strontium titanate particles can be controlled to be small so that the effect of accelerating the rise of charging and suppressing excessive charging can be improved. As a result, sleeve ghosts are unlikely to occur even when the toner is used in a high-temperature and high-humidity environment, and fine line reproducibility and dot reproducibility are improved even when the toner is used over a long period in a high-temperature and high-humidity environment.

The content of strontium oxide and titanium oxide is preferably at least 98.2% by mass. Although the upper limit is not particularly limited, it is preferably not more than 100% by mass. This content can be controlled by refining the titanium raw material and reducing the amount of impurities.

The number average particle diameter of primary particles of strontium titanate in the present invention is characterized by being at least 10 nm and not more than 95 nm. When the number average particle diameter of the primary particles is at least 10 nm, strontium titanate is effectively finely dispersed on the surface of the toner particle to suppress excessive charging of the toner. When the number average particle diameter of the primary particles is not more than 95 nm, it is possible to obtain sufficient adhesion of strontium titanate to the toner particle, to accelerate the rise of the charge quantity of the toner and to effectively suppress the excessive charging of the toner. Therefore, it is possible to provide a toner which is better prevented from causing the sleeve ghosts even when used in a high-temperature and high-humidity environment or a low-temperature and low-humidity environment and which has satisfactory fine line reproducibility and dot reproducibility even when used over a long period in a high-temperature and high-humidity environment.

The number average particle diameter of the primary particles of strontium titanate is preferably at least 10 nm and not more than 70 nm, and more preferably at least 10 nm and not more than 50 nm. The number average particle diameter of the primary particles of strontium titanate can be controlled by the concentration of the titanium raw material and the strontium raw material, the reaction temperature, and the reaction time.

The toner of the present invention is characterized by that a sum total Et of a rotational torque and a vertical load, which is obtained when, in powder flowability analysis, a propeller-type blade is vertically introduced into a powder layer of the toner in a measurement container while being rotated at a periphery speed of the outermost edge portion thereof at 100 mm/sec, measurement is started from a position of 100 mm from a bottom surface of the powder layer, and the propeller-type blade is introduced to a position of 10 mm from the bottom surface, is at least 100 mJ and not more than 2000 mJ.

The measurement condition of the Et shows the flow state of the toner near the developing sleeve against which the toner is rubbed at a high speed in the developing device. In particular, the measurement condition shows a flow state immediately before the toner carried on the surface of the developing sleeve enters the opposing portion between the developer layer thickness regulating member and the developing sleeve.

By controlling the Et to at least 100 mJ and not more than 2000 mJ, the force applied to the toner from the developer layer thickness regulating member can be controlled to be constant, so that the thickness of the toner layer on the developing sleeve can be made uniform. Therefore, even when a large number of images of the same pattern are printed, it is possible to obtain uniform charging performance and flowability of the toner in the printed portion and non-printed portion on the developing sleeve. As a result, sleeve ghosts are prevented and fine line reproducibility and dot reproducibility are improved.

The Et is preferably at least 200 mJ and not more than 1000 mJ, and more preferably at least 200 mJ and not more than 500 mJ.

In order to control the Et, the temperature in the tank of a mixer when mixing the toner particles and an external additive is set to at least −20° C. and not more than −10° C. as a difference between the glass transition temperature Tg of the toner particle and the temperature in the tank [Tg—(the temperature in the tank)]. As a result, it is easier to cause the external additive to adhere to the surface of the toner particle. Therefore, the Et of the toner is easier to control.

The content of strontium titanate is preferably at least 0.05 parts by mass and not more than 2.0 parts by mass, and more preferably at least 0.1 parts by mass and not more than 1.5 parts by mass with respect to 100 parts by mass of the toner particles.

Within the above ranges, it is easy to obtain the effect of suppressing the excessive charging of the toner and the effect of accelerating the rise of the triboelectric charge quantity. Therefore, sleeve ghosts are unlikely to occur even when the toner is used in a high-temperature and high-humidity environment or a low-temperature and low-humidity environment, and fine line reproducibility and dot reproducibility are improved even when the toner is used over a long period in a high-temperature and high-humidity environment.

The strontium titanate of the present invention preferably has a moisture adsorption amount of at least 1 mg/g and not more than 40 mg/g, more preferably at least 1 mg/g and not more than 25 mg/g, and even more preferably at least 1 mg/g and not more than 20 mg/g at a temperature of 30° C. and a humidity of 80% RH.

By controlling the moisture adsorption amount within the above ranges, it is possible to reduce the influence of reduction in the charge quantity in a high-temperature and high-humidity environment, so that the rise of charging can be accelerated and the charge quantity can be made uniform. As a result, sleeve ghosts are unlikely to occur even when the toner is used in a high-temperature and high-humidity environment, and fine line reproducibility and dot reproducibility are improved even when the toner is used over a long period in a high-temperature and high-humidity environment.

Second Aspect

According to the second aspect of the present invention, there is provided a toner characterized by comprising toner particles, inorganic fine particles A, and inorganic fine particles B, wherein a weight average particle diameter (D4) of the toner is at least 3.0 μm and not more than 10.0 μm;

the inorganic fine particles A and the inorganic fine particles B are strontium titanate;

a number average particle diameter of primary particles of the inorganic fine particles A is at least 10 nm and not more than 95 nm;

the inorganic fine particles A have a maximum peak (a) at a diffraction angle (2θ) of at least 32.00 deg and not more than 32.40 deg in CuKα characteristic X-ray diffraction;

a half width of the maximum peak (a) is at least 0.23 deg and not more than 0.50 deg;

the inorganic fine particles A have a water adsorption amount of at least 1 mg/g and not more than 40 mg/g at a relative humidity of 80% in a water adsorption isotherm at 30° C.; and a number average particle diameter of primary particles of the inorganic fine particles B is at least 500 nm and not more than 2000 nm.

The toner according to the second aspect includes the inorganic fine particles A and the inorganic fine particles B. The inorganic fine particles A and the inorganic fine particles B are strontium titanate.

The number average particle diameter of the primary particles of the inorganic fine particles A is at least 10 nm and not more than 95 nm. When the number average particle diameter is at least 10 nm, the inorganic fine particles A are effectively finely dispersed on the surface of the toner particles, and excessive charging of the toner and the inorganic fine particles B is suppressed. Meanwhile, when the number average particle diameter is not more than 95 nm, it is possible to obtain a sufficient adhesive force necessary for the inorganic fine particles A to be present on the toner surface, so that the effect of accelerating the rising of the charge quantity of the toner and the effect of suppressing the excessive charging can be obtained. Therefore, even when the toner is used in a high-temperature and high-humidity environment or a low-temperature and low-humidity environment, the occurrence of sleeve ghosts and white streaks can be suppressed.

The number average particle diameter of the primary particles of the inorganic fine particles A is preferably at least 10 nm and not more than 70 nm, and more preferably at least 10 nm and not more than 50 nm.

Further, the inorganic fine particles A have a maximum peak (a) at a diffraction angle (2θ) of at least 32.00 deg and not more than 32.40 deg in CuKα characteristic X-ray diffraction, and a half width of the maximum peak (a) is at least 0.23 deg and not more than 0.50 deg, preferably at least 0.25 deg and not more than 0.45 deg, and more preferably at least 0.28 deg and not more than 0.40 deg. Such a feature is similar to that of the strontium titanate according to the first aspect, and by using the inorganic fine particles A, it is possible to obtain the effect of accelerating the rise of charging of the toner on the developing sleeve and suppressing the excessive charging.

Meanwhile, the number average particle diameter of the primary particles of the inorganic fine particles B is at least 500 nm and not more than 2000 nm. With such inorganic fine particles B, it is possible to suppress cleaning defects.

The toner remaining on the photosensitive member after the transfer step is scraped by cleaning means such as a cleaning blade which is in contact with the photosensitive member. At this time, a phenomenon that the toner or external additive partially passes through the cleaning blade represents cleaning defects. As a result, the toner or external additive that has passed through contaminates the charging member, or the toner that has passed through becomes a vertical streak and causes image defects.

The number average particle diameter of the primary particles of the inorganic fine particles B is preferably at least 600 nm and not more than 1500 nm, and more preferably at least 600 nm and not more than 1000 nm.

When the toner using the inorganic fine particles B is used, it is conceivable that the inorganic fine particles B scraped by the cleaning blade accumulate at the contact portion between the cleaning blade and the photosensitive member, so that a blocking layer can be formed by the inorganic fine particles B, which results in the effect of preventing the toner or external additive from passing through.

However, it has been found that where an image with a high print percentage is continuously printed, the aggregates of the toner and the inorganic fine particles B occur in the developing device and scrape the sleeve, thereby causing white streaks. Furthermore, it has been found that the effect of suppressing the cleaning defects as a result of the formation of the blocking layer, which is the function of the inorganic fine particles B, is also unlikely to be obtained due to the aggregation of the inorganic fine particles B.

Therefore, as a result of intensive research, the inventors of the present invention have found that by simultaneously using the inorganic fine particles A, it is possible to suppress the occurrence of aggregates of the toner and the inorganic fine particles B, and to suppress white streaks while suppressing the cleaning defects.

The following reason for obtaining the abovementioned effects can be presumed. It is known that the inorganic fine particles B which are strontium titanate having a particle diameter of at least 500 nm and not more than 2000 nm have an effect of imparting charging to the toner. In particular, when an image with a high print percentage is continuously printed, it is conceivable that the rise of charging of the toner is decelerated, and the charge imparting effect of the inorganic fine particles B is increased. At this time, since the inorganic fine particles B are charged to a polarity opposite to that of the toner, it is conceivable that an electrostatic adhesion force acts strongly between the toner and the inorganic fine particles B and that aggregates are generated and cause white streaks. Furthermore, when the inorganic fine particles B are present as agglomerates with the toner, it is conceivable that the function of forming a blocking layer in the cleaning blade portion is also hindered, which causes the cleaning defects.

Meanwhile, it is conceivable that the inorganic fine particles A make it possible to obtain the above-described effect of suppressing the excessive charging of the toner and the inorganic fine particles B. It is conceivable that the electrostatic adhesion force generated between the toner and the inorganic fine particles B is relaxed under the effect of the inorganic fine particles A, thereby making it possible to suppress the occurrence of the aggregates. It is conceivable that this can result in the suppression of cleaning defects and white streaks.

In the second aspect, it is important that the weight average particle diameter (D4) of the toner be at least 3.0 μm and not more than 10.0 μm. Within this range, the inorganic fine particles A can be effectively finely dispersed on the toner surface.

The weight average particle diameter (D4) is preferably at least 4.0 μm and not more than 9.0 μm, more preferably at least 4.5 μm and not more than 8.5 μm, and even more preferably at least 5.0 μm and not more than 8.0 μm.

Further, it is important that the inorganic fine particles A have a water adsorption amount of at least 1 mg/g and not more than 40 mg/g at a relative humidity of 80% in a water adsorption isotherm at 30° C. By controlling the moisture adsorption amount within the above range, it is possible to effectively reduce the influence of moisture on charge control particularly in a high-temperature and high-humidity environment, accelerate the rise of the triboelectric charge quantity, effectively obtain the excessive charging suppression effect, and suppress the occurrence of sleeve ghosts and white streaks.

The moisture adsorption amount is more preferably at least 1 mg/g and not more than 25 mg/g, and even more preferably at least 1 mg/g and not more than 20 mg/g. As a result, sleeve ghosts are unlikely to occur even when the toner is used in a high-temperature and high-humidity environment. The moisture adsorption amount can be controlled by surface-treating the inorganic fine particles A with a hydrophobic treatment agent.

The content of the inorganic fine particles A is preferably at least 0.05 parts by mass and not more than 2.0 parts by mass, and more preferably at least 0.1 parts by mass and not more than 1.5 parts by mass with respect to 100 parts by mass of the toner particles.

By setting the content of the inorganic fine particles A in the above range, it is easy to obtain the effect of suppressing the excessive charging of the toner and the effect of accelerating the rising of the charging, so that sleeve ghosts and white streaks are better prevented even when the toner is used in a high-temperature and high-humidity environment or a low-temperature and low-humidity environment.

Further, from the viewpoint of suppressing the occurrence of aggregates, the mass ratio [A/B] of the inorganic fine particles A and the inorganic fine particles B is preferably 1.0/1.0 to 1.0/20.0, and more preferably 1.0/3.0 to 1.0/18.0.

It is preferable that the inorganic fine particles A have a maximum peak (a) at a diffraction angle (2θ) of at least 32.00 deg and not more than 32.40 deg in CuKα characteristic X-ray diffraction, and that an intensity (Ia) of the maximum peak (a) and a maximum peak intensity (Ix) in a range of a diffraction angle (2θ) of at least 24.00 deg and not more than 28.00 deg in CuKα characteristic X-ray diffraction satisfy the following formula:

$$(Ix)/(Ia) \leq 0.010.$$

It is more preferable that (Ix)/(Ia) be not more than 0.008.

This feature is similar to that of the first aspect. When the above formula is satisfied, the number of impurities localized at the crystal grain boundaries is reduced, the rise of charging of the toner is accelerated, the excessive charging suppression effect is easily obtained, and cleaning defects, sleeve ghosts and white streaks are unlikely to occur.

It is preferable that the inorganic fine particles A be such that, when all elements detected by X-ray fluorescence analysis of the inorganic fine particles A are considered to be in the form of oxides and when a total amount of all oxides is taken as 100% by mass, a total content of strontium oxide and titanium oxide is at least 98.0% by mass, more preferably at least 98.2% by mass.

This feature is similar to that of the first aspect. When the above range is satisfied, the rise of charging is accelerated and excessive charging is likely to be suppressed. As a result, cleaning defects, sleeve ghosts and white streaks are unlikely to occur.

Next, preferred embodiments in the first aspect and second aspect will be described.

The strontium titanate or inorganic fine particles A are preferably surface-treated, if necessary, for the purpose of controlling hydrophobicity and triboelectric charging property. Thus, examples of the treatment agents include unmodified silicone varnishes, various modified silicone varnishes, unmodified silicone oils, various modified silicone oils, silane coupling agents, silane compounds having functional groups, and other organosilicon compounds. Various treatment agents may be used in combination. Among them, it is particularly preferable that the treatment be performed with a silane coupling agent. Thus, it is preferable that the strontium titanate or the inorganic fine particles A be fine particles surface-treated with a silane coupling agent.

Examples of the silane coupling agent include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, n-octadecyltrimethoxysilane, trifluoropropyltrimethoxysilane, and hydrolyzates thereof.

Among them, n-octyltriethoxysilane, isobutyltrimethoxysilane, and trifluoropropyltrimethoxysilane are preferable, and isobutyltrimethoxysilane is more preferable. Further, one kind of these treatment agents may be used singly, or two or more kinds may be used in combination.

The surface of the strontium titanate particles can be chemically modified by the surface treatment, but the surface treatment does not affect the crystal structure of the strontium titanate particles. Thus, the surface treatment does not affect the half width of the maximum peak (a) of strontium titanate. Therefore, in the present invention, X-ray fluorescence measurement of strontium titanate or inorganic fine particles A is performed before the surface treatment in order to measure the impurity elements affecting the crystal structure.

In the first aspect and the second aspect, the specific surface area of the strontium titanate or the inorganic fine particles A measured by a BET method by nitrogen adsorption after the surface treatment is preferably at least 10 $m^2/g$ and not more than 200 $m^2/g$, and more preferably at least 10 $m^2/g$ and not more than 100 $m^2/g$. As a result of controlling the BET specific surface area within the above ranges, the inorganic fine particles are likely to be uniformly and finely dispersed on the toner surface, so that it is possible to exert the sufficient effect of suppressing the excessive charging of the toner and the effect of accelerating the rise of charging.

The preparation method of the strontium titanate or the inorganic fine particles A is not particularly limited, and, for example, the following method can be used.

For example, synthesis can be performed by adding strontium nitrate, strontium chloride or the like to a titania sol dispersion obtained by adjusting the pH of a hydrous titanium oxide slurry obtained by hydrolysis of an aqueous solution of titanyl sulfate, heating to a reaction temperature, and then adding an aqueous alkali solution. The reaction temperature is preferably 60° C. to 100° C.

It is preferable that the time taken to add the alkaline aqueous solution be not more than 60 min in the step of adding the alkaline aqueous solution in order to control the half width of the maximum peak (a). By setting the addition rate of the alkaline aqueous solution to not more than 60 min, it is possible to obtain particles with a small crystallite size.

Furthermore, in terms of controlling the half width, it is preferable to perform the addition while applying ultrasonic vibrations in the step of adding the alkaline aqueous solution. As a result of applying ultrasonic vibrations in the reaction step, the deposition rate of the crystals is increased and particles with small crystallite size can be obtained.

Further, in terms of controlling the half width, it is preferable to cool rapidly the aqueous solution after completion of the reaction by adding an aqueous alkaline solution. Such rapidly cooling can be implemented, for example, by a method of adding pure water cooled to not more than 10° C. until reaching a desired temperature. By rapidly cooling, it is possible to suppress the increase in the crystallite size in the cooling step.

Meanwhile, a strong processing method (a method of mechanically applying a strong force to inorganic fine particles) may be used as a method for controlling the half width. Examples of the strong processing methods include a ball mill method, torsion of high pressure, falling weight processing, particle impact, air-type shot peening, and the like.

In order to improve charging stability, developing performance, flowability and durability, it is preferable that the toner of the present invention include silica fine powder as inorganic fine particles in addition to strontium titanate. The silica fine powder preferably has a specific surface area of at least 30 $m^2/g$ and not more than 500 $m^2/g$, and more preferably at least 50 $m^2/g$ and not more than 400 $m^2/g$, as determined by the BET method based on nitrogen adsorption. The content of the silica fine powder is preferably at least 0.01 parts by mass and not more than 8.0 parts by mass, and more preferably at least 0.10 parts by mass and not more than 5.0 parts by mass, per 100 parts by mass of the toner particles.

It is preferable that the silica fine powder be surface-treated, if necessary, for the purpose of controlling hydrophobicity and triboelectric charging performance, with a treatment agent such as unmodified silicone varnishes, various modified silicone varnishes, unmodified silicone oils, various modified silicone oils, silane coupling agents, silane compounds having functional groups, and other organosilicon compounds, or with a combination of various treatment agents.

Other external additives may be added to the toner as necessary. Examples of such external additives include resin fine particles or inorganic fine particles that act as a charge adjuvant, a conductivity-imparting agent, a flowability-imparting agent, a caking inhibitor, a release agent at the time of heat roller fixing, a lubricant, a polishing agent and the like. Examples of the lubricant include polyethylene fluoride powder, zinc stearate powder, and polyvinylidene fluoride powder. Examples of the polishing agent include cerium oxide powder and silicon carbide powder.

The toner particle may include a binder resin. Examples of the binder resin are presented hereinbelow.

A styrene resin, a styrene copolymer resin, a polyester resin, a polyol resin, a polyvinyl chloride resin, a phenolic resin, a natural resin-modified phenolic resin, a natural resin-modified maleic acid resin, an acrylic resin, a methacrylic resin, polyvinyl acetate, a silicone resin, a polyurethane resin, a polyamide resin, a furan resin, an epoxy resin, a xylene resin, a polyvinyl butyral, a terpene resin, a coumarone indene resin, a petroleum resin. Preferable examples of the resin include a styrene copolymer resin, a polyester resin, and a hybrid resin in which a polyester resin and a styrene type copolymer resin are mixed or partially reacted. More preferably, the binder resin includes a polyester resin.

From the viewpoint of storage stability, it is preferable that the glass transition temperature (Tg) of the binder resin be at least 45° C. From the viewpoint of low-temperature fixability, it is preferable that the Tg be not more than 75° C., and more preferably not more than 70° C. A method for measuring the glass transition temperature will be described later.

A release agent (wax) may be used to impart releasability to the toner.

Examples of the wax are presented hereinbelow. Aliphatic hydrocarbon waxes such as low-molecular-weight polyethylene, low-molecular-weight polypropylene, an olefin copolymer, microcrystalline wax, paraffin wax and Fischer-Tropsch wax; oxidized waxes of aliphatic hydrocarbon waxes such as oxidized polyethylene wax; waxes composed mainly of fatty acid esters such as carnauba wax, behenyl behenate and montanic acid ester wax; and waxes obtained partially or wholly deacidifying fatty acid esters, such as deacidified carnauba wax.

Other examples include saturated linear fatty acids such as palmitic acid, stearic acid and montanic acid; unsaturated fatty acids such as brassidic acid, eleostearic acid and varinaric acid; saturated alcohols such as stearyl alcohol, aralkyl alcohol, behenyl alcohol, carnaubyl alcohol, seryl alcohol and melissyl alcohol; polyhydric alcohols such as sorbitol; fatty acid amides such as linoleic acid amide, oleic acid amide and lauric acid amide; saturated fatty acid bisamides such as methylene bis-stearic acid amide, ethylene bis-caprylic acid amide, ethylene bis-lauric acid amide and hexamethylene bis-stearic acid amide; unsaturated fatty acid amides such as ethylene bis-oleic acid amide, hexamethylene bis-oleic acid amide, N,N'-dioleyl adipic acid amide and N,N'-dioleyl sebacic acid amide; aromatic bisamides such as m-xylene bis-stearic acid amide and N,N'-distearyl isophthalic acid amide; aliphatic metal salts such as calcium stearate, calcium laurate, zinc stearate and magnesium stearate (commonly referred to as metallic soaps); waxes obtained by grafting aliphatic hydrocarbon waxes by using a vinyl-based comonomer such as styrene and acrylic acid; partially esterified products of fatty acids and polyhydric alcohols such as behenic acid monoglycerides; methyl ester compounds having a hydroxyl group which are obtained by hydrogenation of vegetable oils and the like.

The wax particularly preferable for use in the present invention is an aliphatic hydrocarbon wax. Preferred examples thereof include hydrocarbons having a low molecular weight which are obtained by radical polymerization of an alkylene under a high pressure or polymerization under a low pressure with a Ziegler catalyst or a metallocene catalyst; a Fischer-Tropsch wax synthesized from coal or natural gas; an olefin polymer obtained by thermal decomposition of an olefin polymer having a high molecular weight; a synthetic hydrocarbon wax obtained from a distillation residue of a hydrocarbon obtained by an Arge process from a synthetic gas including carbon monoxide and hydrogen; and a synthetic hydrocarbon wax obtained by hydrogenating such hydrocarbon waxes.

Further, it is more preferable to use a product obtained by fractionation of a hydrocarbon wax by a press wiping method or a solvent method, by using vacuum distillation, or by a fractional crystallization method. In particular, wax synthesized by a method which does not rely on polymerization of an alkylene is preferable in view of the molecular weight distribution thereof.

The wax may be added when the toner is produced or when the binder resin is produced. Further, one kind of the waxes may be used singly, or two or more kinds of the waxes may be used in combination. The wax is preferably added in an amount of at least 1 part by mass and not more than 20 parts by mass with respect to 100 parts by mass of the binder resin.

The toner of the present invention can be used as any one of a magnetic one-component toner, a nonmagnetic one-component toner and a nonmagnetic two-component toner.

When the toner is used as a magnetic one-component toner, magnetic iron oxide particles are preferably used as a colorant. Examples of the magnetic iron oxide particles contained in the magnetic one-component toner include magnetic iron oxide such as magnetite, maghemite and ferrite, and magnetic iron oxide including other metal oxides; metals such as Fe, Co, and Ni; alloys of these metals with metals such as Al, Co, Cu, Pb, Mg, Ni, Sn, Zn, Sb, Be, Bi, Cd, Ca, Mn, Se, Ti, W, and V, and mixtures thereof. The content of the magnetic iron oxide particles is preferably at least 30 parts by mass and not more than 100 parts by mass with respect to 100 parts by mass of the binder resin.

Examples of the colorant for use in a nonmagnetic one-component toner and a nonmagnetic two-component toner are presented hereinbelow.

As a black pigment, carbon black such as furnace black, channel black, acetylene black, thermal black and lamp black can be used, and magnetic powder such as magnetite and ferrite can also be used.

As a coloring agent suitable for yellow color, pigments or dyes can be used. Examples of the pigments include C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191, and C. I. Vat Yellow 1, 3, and 20. Examples of the dyes include C. I. Solvent Yellow 19, 44, 77, 79, 81, 82, 93, 98, 103, 104, 112, 162, and the like. These are used singly or in combination of two or more.

As a colorant suitable for cyan color, pigments or dyes can be used. Examples of the pigments include C. I. Pigment Blue 1, 7, 15, 15:1, 15:2, 15:3, 15:4, 16, 17, 60, 62, 66, and the like, C. I. Vat Blue 6, and C. I. Acid Blue 45. Examples of the dyes include C. I. Solvent Blue 25, 36, 60, 70, 93, 95, and the like. These are used singly or in combination of two or more.

As a colorant suitable for magenta color, pigments or dyes can be used. Examples of the pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, 254, and the like, C. I. Pigment Violet 19, and C. I. Vat Red 1, 2, 10, 13, 15, 23, 29, and 35.

Examples of the magenta dyes include oil-soluble dyes such as C. I. Solvent Red 1, 3, 8, 23, 24, 25, 27, 30, 49, 52, 58, 63, 81, 82, 83, 84, 100, 109, 111, 121, 122, and the like, C. I. Disperse Red 9, C. I. Solvent Violet 8, 13, 14, 21, 27, and the like, C. I. Disperse Violet 1, and the like, and basic dyes such as C. I. Basic Red 1, 2, 9, 12, 13, 14, 15, 17, 18, 22, 23, 24, 27, 29, 32, 34, 35, 36, 37, 38, 39, 40 and the like, C. I. Basic Violet 1, 3, 7, 10, 14, 15, 21, 25, 26, 27, 28, and the like. These are used singly or in combination of two or more.

The content of the colorant is preferably at least 1 part by mass and not more than 20 parts by mass with respect to 100 parts by mass of the binder resin.

A charge control agent may be used in the toner. Known charge control agents can be used, and examples thereof include azo iron compounds, azo chromium compounds, azo manganese compounds, azo cobalt compounds, azo zirconium compounds, chromium compounds of carboxylic acid derivatives, zinc compounds of carboxylic acid derivatives, aluminum compounds of carboxylic acid derivatives, and zirconium compounds of carboxylic acid derivatives.

The carboxylic acid derivative is preferably an aromatic hydroxycarboxylic acid. A charge control resins can also be used. When a charge control agent or charge control resin is used, it is preferably used in an amount of at least 0.1 parts by mass and not more than 10 parts by mass with respect to 100 parts by mass of the binder resin.

The toner may be mixed with a carrier and used as a two-component developer. As the carrier, a usual carrier such as ferrite and magnetite, or a resin-coated carrier can be used. Further, a binder-type carrier core in which magnetic powder is dispersed in a resin can also be used.

The resin-coated carrier is composed of a carrier core particle and a coating material which is a resin that covers (coats) the surface of the carrier core particle. Examples of the resin used for the coating material include styrene-acrylic resins such as a styrene-acrylic acid ester copolymer and a styrene-methacrylic acid ester copolymer; acrylic resins such as an acrylic acid ester copolymer and a methacrylic acid ester copolymer; fluorine-including resins such as polytetrafluoroethylene, monochlorotrifluoroethylene polymer and polyvinylidene fluoride; silicone resins; polyester resins; polyamide resins; polyvinyl butyral; and aminoacrylate resins. Other examples include ionomer resins and polyphenylene sulfide resins. These resins can be used singly or in combination.

A method for producing the toner is not particularly limited, and a known method such as a pulverization method, a suspension polymerization method and an emulsion aggregation method can be used. Hereinafter, the method for producing the toner will be described by taking the pulverization method as an example, but this method is not limiting.

For example, a binder resin and, if necessary, a coloring agent and other additives are thoroughly mixed with a mixer such as a Henschel mixer or a ball mill, then subjected to melt kneading by using a thermal kneader such as a heating roll, a kneader, and an extruder, cooled and solidified, and pulverized and classified to obtain toner particles. The toner is then obtained by sufficiently mixing the toner particles with the strontium titanate or inorganic fine particles A and B, and optionally with silica fine powder and the like with a mixer such as a Henschel mixer.

Examples of the mixer are presented below. Henschel mixer (manufactured by Mitsui Mining Co., Ltd.); SUPER-MIXER (manufactured by Kawata Mfg Co., Ltd.); RIBO-CONE (manufactured by Okawara Mfg. Co., Ltd.); NAUTA MIXER, TURBULIZER, and CYCLOMIX (manufactured by Hosokawa Micron Corporation); SPIRAL PIN MIXER (manufactured by Pacific Machinery & Engineering Co., Ltd.); and LODIGE MIXER (manufactured by Matsubo Corporation).

Examples of the kneader are presented below. KRC kneader (manufactured by Kurimoto, Ltd.); BUSS Co-kneader (manufactured by Buss AG); TEM-type extruder (manufactured by Toshiba Machine Co., Ltd.); TEX twin-screw kneader (manufactured by The Japan Steel Works, Ltd.); PCM kneader (manufactured by Ikegai Ironworks Corp.); a three-roll mill, a mixing roll mill, and a kneader (manufactured by Inoue Seisakusho Co., Ltd.); KNEADEX (manufactured by Mitsui Mining Co., Ltd.); MS-type pressurizing kneader and KNEADER-RUDER (manufactured by Moriyama Works); and Banbury mixer (manufactured by Kobe Steel, Ltd.).

Examples of the pulverizer are presented below. COUNTER JET MILL, MICRON JET, and INNOMIZER (manufactured by Hosokawa Micron Corporation); IDS type mill and PJM jet pulverizer (manufactured by Nippon Pneumatic Mfg. Co., Ltd.); CROSS JET MILL (manufactured by Kurimoto, Ltd.); ULMAX (manufactured by Nisso Engineering Co., Ltd.); SK Jet-O-Mill (manufactured by Seishin Enterprise Co., Ltd.); KRYPTRON (manufactured by EARTHTECHNICA Co, Ltd.); TURBO MILL (manufactured by Turbo Kogyo Co., Ltd.); and SUPER-ROTOR (manufactured by Nisshin Engineering Inc.).

Examples of the classifier are presented below. CLASSIEL, MICRON CLASSIFIER, and SPEDIC CLASSIFIER (manufactured by Seishin Enterprise Co., Ltd.); TURBO CLASSIFIER (manufactured by Nisshin Engineering Inc.); MICRON SEPARATOR, TURBOPLEX (ATP), TSP SEPARATOR, and TTSP SEPARATOR (manufactured by Hosokawa Micron Corporation); ELBOW JET (manufactured by Nittetsu Mining Co., Ltd.); DISPERSION SEPARATOR (manufactured by Nippon Pneumatic Mfg. Co., Ltd.); and YM MICRO CUT (manufactured by Yaskawa & Co., Ltd.).

Examples of the sieving device used for sieving coarse particles are presented below. ULTRASONIC (manufactured by Koeisangyo Co., Ltd.); RESONA-SIEVE and GYRO-SIFTER (manufactured by Tokuju Corporation); VIBRASONIC SYSTEM (manufactured by Dalton Corporation); SONICLEAN (manufactured by Sintokogio, Ltd.); TURBO SCREENER (manufactured by Turbo Kogyo Co., Ltd.); MICRO SHIFTER (manufactured by Makino Mfg. Co., Ltd.); and a circular vibration sieve.

Next, methods for measuring physical properties according to the present invention will be described.

X-Ray Diffraction Measurement

Measurement is performed using MiniFlex 600 (manufactured by Rigaku Corporation) under the following conditions.

A measurement sample is placed on a nonreflective sample plate (manufactured by Rigaku Corporation) having no diffraction peaks within the measurement range, while lightly pressing inorganic fine particles (strontium titanate) to obtain a flat configuration and maintaining a powder state. The flattened particles are set with the sample plate at the device.

Measurement Conditions of X-Ray Diffraction

Tube: Cu
Parallel beam optical system
Voltage: 40 kV
Current: 15 mA
Start angle: 3°
End angle: 60°
Sampling width: 0.02°
Scan speed: 10.00°/min
Divergence slit: 0.625 deg
Scattering slit: 8.0 mm
Receiving slit: 13.0 mm (Open)

The half width and peak intensity of the obtained X-ray diffraction peak are calculated using analytical software "PDXL" produced by Rigaku Corporation.

X-ray Fluorescence Measurement

When surface treatment is performed with a silane coupling agent or the like, X-ray fluorescence measurement of the inorganic fine particles (strontium titanate or inorganic fine particles A) is performed before the surface treatment.

Elements from Na to U in the inorganic fine particle are directly measured under a He atmosphere by using a wavelength dispersive X-ray fluorescence analyzer Axios advanced (manufactured by Spectris Co., Ltd.). A cup for a liquid sample which is provided with the device is used, a polypropylene (PP) film is stretched on the bottom, a sufficient amount of the sample is introduced, a layer with uniform thickness is formed on the bottom, and the cup is covered with a lid. Measurement is performed under the condition of an output of 2.4 kW. A fundamental parameter (FP) method is used for analysis. At that time, it is assumed that all the detected elements are in the form of oxides, and the total mass thereof is taken as 100% by mass. The content (% by mass) of strontium oxide (SrO) and titanium oxide ($TiO_2$) based on the total mass is determined as oxide equivalent value in software UniQuant 5 (ver.5.49) (produced by Spectris Co., Ltd.).

Measurement of Number Average Particle Diameter of Primary Particles of Inorganic Fine Particles The number average particle diameter of the primary particles of the inorganic fine particles (strontium titanate, inorganic fine particles A and B) is determined by observations with a transmission electron microscope "H-800" (manufactured by Hitachi, Ltd.) in which a major diameter of 100 primary particles is measured in a field magnified up to 2,000,000 times, and the number average particle diameter thereof is found.

Measurement of Water Adsorption Amount

The moisture adsorption amount of the inorganic fine particles (strontium titanate or inorganic fine particles A) is measured using "High-precision vapor adsorption amount measuring device BELSORP-aqua 3" (Nippon Bell Co., Ltd.).

In the " High-precision vapor adsorption amount measuring device BELSORP-aqua 3", a solid-gas equilibrium is reached under the condition that only the target gas (water in the case of the present invention) is present, and the solid mass and vapor pressure are measured at this time.

First, about 0.5 g of a sample is introduced into a sample cell and degassed for 24 h at room temperature under 100 Pa. After completion of degassing, the sample mass is precisely weighed, the sample set in the main body of the device, and measurement is carried out under the following conditions.

Air thermostat temperature: 80.0° C.
Adsorption temperature: 30.0° C.
Adsorbate name: $H_2O$
Equilibration time: 500 sec
Wait for temperature: 60 min
Saturated vapor pressure: 4.245 kPa
Sample tube exhaust speed: Normal
Introducing pressure, initial introduction amount: 0.20 $cm^3$ (STP)$\cdot g^{-1}$
Measurement relative pressure range P/PO (measurement of adsorption process): 0.05, 0.15, 0.25, 0.35, 0.45, 0.55, 0.65, 0.75, 0.85, 0.90, 0.95

Measurement is conducted under the abovementioned conditions, a moisture adsorption/desorption isotherm at a temperature of 30° C. is plotted, and the water adsorption amount (mg/g) per 1 g of the sample at a humidity of 80% RH in the adsorption process is calculated.

Measurement of Weight Average Particle Diameter (D4) of Toner

As a measuring device, a precision particle diameter distribution measuring device "Coulter Counter Multisizer 3" (registered trademark, manufactured by Beckman Coulter, Inc.) equipped with a 100 μm aperture tube is used. The supplied special software "Beckman Coulter Multisizer 3 Version 3.51" (produced by Beckman Coulter, Inc.) is used to set measurement conditions and analyze measurement data. Measurement is conducted with 25,000 effective measurement channels.

A solution prepared by dissolving special grade sodium chloride in ion exchanged water to a concentration of about 1% by mass, for example, "ISOTON II" (manufactured by Beckman Coulter, Inc.), can be used as an electrolytic aqueous solution for the measurement.

Prior to measurement and analysis, the dedicated software is set as follows.

On the "CHANGE STANDARD MEASUREMENT METHOD (SOM)" screen of the dedicated software, the total count number in the control mode is set to 50,000 particles, the number of measurement cycles is set to one, and a value obtained by using "STANDARD PARTICLES 10.0 μm" (manufactured by Beckman Coulter, Inc.) is set as a Kd value. The threshold and the noise level are automatically set by pressing the "THRESHOLD/NOISE LEVEL MEASUREMENT BUTTON". Further, the current is set to 1600 μA, the gain is set to 2, the electrolytic solution is set to ISOTON II, and "FLUSH APERTURE TUBE AFTER MEASUREMENT" is checked.

In the "SETTING CONVERSION FROM PULSE TO PARTICLE DIAMETER" screen of the dedicated software, the bin interval is set to a logarithmic particle diameter, the particle diameter bin is set to 256 particle diameter bins, and the particle diameter range is set to 2 μm to 60 μm.

Specific measurement methods are as follows.

(1) Approximately 200 ml of the electrolytic solution is placed in a glass 250 ml round-bottom beaker dedicated to Multisizer 3, the beaker is set in the sample stand, and stirring with a stirrer rod is carried out counterclockwise at 24 rps. Dirt and air bubbles in the aperture tube are removed by the "FLUSH OF APERTURE" function of the dedicated software.

(2) Approximately 30 ml of the electrolytic aqueous solution is placed in a glass 100 ml flat-bottom beaker. Then, as a dispersant, about 0.3 ml of a diluted solution obtained by about 3-fold mass dilution of "Contaminon N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchanged water is placed in the water tank of the ultrasonic disperser, and about 2 ml of Contaminon N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to at least 10° C. and not more than 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the weight average particle diameter (D4) and the number average particle diameter (D1) are calculated. The "AVERAGE DIAMETER" on the "ANALYSIS/VOLUME STATISTICAL VALUE (ARITHMETIC MEAN)" screen obtained when the graph/(% by volume) is set in the dedicated software is the weight average particle diameter (D4), and the "AVERAGE DIAMETER" on the "ANALYSIS/NUMERICAL STATISTICAL VALUE (ARITHMETIC MEAN)" screen obtained when the graph/(% by number) is set in the dedicated software is the number average particle diameter (D1).

Method for Measuring Glass Transition Temperature (Tg) of Toner Particle or Binder Resin The glass transition temperature (Tg) of the toner particle or the binder resin is measured at normal temperature and normal humidity in accordance with ASTM D3418-82 by using a differential scanning calorimeter (DSC), MDSC-2920 (manufactured by TA Instruments). Approximately 3 mg of measurement sample is weighed precisely and used. The sample is placed in an aluminum pan, and an empty aluminum pan is used as a reference. The measurement temperature range is set to at least 30° C. and not more than 200° C., the temperature is raised from 30° C. to 200° C. at a temperature rise rate of 10° C./min, the temperature is then lowered from 200° C. to 30° C. at a temperature lowering rate of 10° C./min, and then the temperature is again raised to 200° C. at a temperature rise rate of 10° C./min.

In the DSC curve obtained in the second temperature rise process, the intersection of the line at the midpoint of the baseline before and after the specific heat change appears and the differential thermal curve is taken as the glass transition temperature Tg.

Method for Measuring Et

A powder flowability analyzer (Powder Rheometer FT-4, manufactured by Freeman Technology) (hereinafter also referred to as "FT-4") equipped with a rotary blade is used to measure Et.

The principle of the device is to move the rotary blade in a powder sample and cause a constant pattern of flow. The particles in the powder sample flow when the blade is close thereto and rest once again as the blade passes through. The energy required for the blade to move through the powder is measured, and various flow indexes are calculated from the energy value. The blade is of a propeller type, and the blade moves up or down while rotating, so that the blade tip draws a spiral. By changing the rotation speed and the vertical movement, it is possible to adjust the angle and speed of the spiral path of the blade. When the blade moves along the spiral path clockwise with respect to the surface of the powder layer, the blade acts to mix the powder uniformly. Conversely, when the blade moves along the spiral path counterclockwise with respect to the surface of the powder layer, the blade receives resistance from the powder.

Specifically, measurement is carried out by the following operation. In all operations, a blade having a diameter of 48 mm and specifically designed for measurement with FT-4 (the rotation axis is in the normal direction at the center of a 48 mm×10 mm blade plate; the blade plate is twisted smoothly counterclockwise such that both outermost edge portions (portions at a distance of 24 mm from the rotating shaft) is at 70° and a portion at a distance of 12 mm from the rotating shaft is at 35° ; the blade material is SUS. Model number: C210. Also referred to hereinbelow as "blade") is used as the propeller-type blade.

First, a toner powder layer is obtained by placing 100 g of the toner left to stand for at least 3 days at 23° C. and 60% environment in a 50 mm×160 ml split container specifically designed for measurement with FT-4 (model number: C 203; height from the bottom of the container to the split part is 82 mm; the material is glass; also referred to hereinbelow as "container").

(1) Conditioning Operation (a) The rotation speed of the blade (the peripheral speed of the outermost edge portion of the blade) is set to 60 (mm/sec). The speed of entry into the powder layer in the vertical direction is set such that the angle formed between the locus drawn by the outermost edge portion of the moving blade and the surface of the powder layer (also referred to hereinbelow as "formed angle") is 5 (deg). The blade is advanced from the surface of the powder layer to a position of 10 mm from the bottom surface of the toner powder layer in the clockwise rotation direction (direction in which the powder layer is loosened by rotation of the blade) with respect to the surface of the powder layer. Then, an operation of introducing the blade to a position of 1 mm from the bottom surface of the toner powder layer is performed in the clockwise rotation direction with respect to the surface of the powder layer at a rotation speed of the blade of 60 (mm/sec) and the speed of entry into the powder layer in the vertical direction such that the formed angle is 2 (deg). Then, the blade is moved to a position of 100 mm from the bottom surface of the toner powder layer and extracted in the clockwise rotation direction with respect to the surface of the powder layer at a rotation speed of the blade of 60 (mm/sec) and the speed of extraction from the powder layer such that the formed angle is 5 (deg). When extraction is completed, the blade is slightly rotated clockwise and counterclockwise alternately to sweep off the toner adhering to the blade.

(b) By performing the series of operations (1)-(a) five times, the air entrained in the toner powder layer is removed and a stable toner powder layer is produced.

(2) Split Operation

The toner powder layer is scraped off by the split portion of a cell specifically designed for measurement with FT-4, and the toner on the upper portion of the powder layer is removed to form a toner powder layer of the same volume.

(3) Measurement Operation (a) The same operation as in (1)-(a) above is carried out once.

(b) Next, the rotation speed of the blade is set to 100 (mm/sec), and the speed of entry into the powder layer in the vertical direction is set such that the formed angle is 5 (deg). The blade is advanced in the counterclockwise rotation direction (direction in which the powder layer is pushed in by the rotation of the blade) with respect to the surface of the powder layer to a position of 10 mm from the bottom surface of the toner powder layer. Then, an operation of introducing the blade to a position of 1 mm from the bottom surface of the toner powder layer is performed in the clockwise rotation direction with respect to the surface of the powder layer at a rotation speed of the blade of 60 (mm/sec) and the speed of entry into the powder layer in the vertical direction such that the formed angle is 2 (deg). Then, the blade is extracted to a position of 100 mm from the bottom surface of the toner powder layer in the clockwise rotation direction with respect to the surface of the powder layer at a rotation speed of the blade of 60 (mm/sec) and the speed of extraction from the powder layer in the vertical direction such that the formed angle is 5 (deg). When extraction is completed, the blade is slightly rotated clockwise and counterclockwise alternately to sweep off the toner adhering to the blade.

(c) The series of operations (b) is repeated seven times.

A sum total Et of a rotational torque and a vertical load, which is obtained when the blade is advanced from a position of 100 mm to a position of 10 mm from the bottom surface of the toner powder layer at a rotation speed of the blade in the seventh cycle of 100 (mm/sec) in the operation (c) above is taken as Et (mJ).

EXAMPLES

Hereinafter, the invention of the present application will be specifically described based on examples. However, the invention of the present application is not limited to the examples. In the following examples, parts and percentages are on a mass basis unless otherwise specified.

The first aspect of the present invention will be described with reference to examples.

Production Example of Strontium Titanate A-1

A hydrous titanium oxide slurry obtained by hydrolyzing a titanyl sulfate aqueous solution was washed with an alkaline aqueous solution until the electric conductivity of the supernatant liquid reached 50 μS/cm to reduce the amount of impurities and purify the slurry. Next, hydrochloric acid was added to the hydrous titanium oxide slurry to adjust the pH to 0.7 and obtain a titania sol dispersion.

A 1.3-fold molar amount of a strontium chloride aqueous solution was added to 2.2 mol (in terms of titanium oxide) of the titania sol dispersion, and the dispersion was placed in a reaction vessel and purged with nitrogen gas. Further, pure water was added so as to obtain 1.1 mol/L in terms of titanium oxide.

Next, after stirring and mixing and heating to 90° C., 440 mL of a 10N sodium hydroxide aqueous solution was added over 15 min while applying ultrasonic vibrations, and the reaction was thereafter carried out for 20 min. Pure water at 5° C. was added to the slurry after the reaction, the slurry was rapidly cooled to not more than 30° C., and the supernatant was then removed. Further, a hydrochloric acid aqueous solution having a pH of 5.0 was added to the slurry, followed by stirring for 1 h to dissolve and remove strontium carbonate. Washing with pure water was thereafter repeated, a part of the resultant cake was sampled and dried, and X-ray diffraction and X-ray fluorescence measurement were thereafter performed. The results are shown in Table 1.

Subsequently, a hydrochloric acid aqueous solution having a pH of 3.0 was added to the slurry, and isobutyltrimethoxysilane was added at 7.0% by mass with respect to the solid content of the slurry, followed by stirring for 10 h. Thereafter, neutralization was performed with a sodium hydroxide aqueous solution, followed by filtration with Nutsche and washing with pure water. The obtained cake was dried to obtain strontium titanate A-1. Physical properties are shown in Table 1.

Production Example of Strontium Titanate A-2

A hydrous titanium oxide slurry obtained by hydrolyzing a titanyl sulfate aqueous solution was washed with an alkaline aqueous solution until the electric conductivity of the supernatant liquid reached 50 μS/cm to reduce the amount of impurities and purify the slurry. Next, hydrochloric acid was added to the hydrous titanium oxide slurry to adjust the pH to 0.7 and obtain a titania sol dispersion.

A 1.2-fold molar amount of a strontium chloride aqueous solution was added to 2.6 mol (in terms of titanium oxide) of the titania sol dispersion, and the dispersion was placed in a reaction vessel and purged with nitrogen gas. Further, pure water was added so as to obtain a titanium oxide concentration of 1.3 mol/L.

Next, after stirring and mixing and heating to 95° C., 312 mL of a 15N sodium hydroxide aqueous solution was added over 5 min while applying ultrasonic vibrations, and the reaction was thereafter carried out for 20 min. Pure water at 5° C. was added to the slurry after the reaction, the slurry was rapidly cooled to not more than 30° C., and the supernatant was then removed. Further, a hydrochloric acid aqueous solution having a pH of 5.0 was added to the slurry, followed by stirring for 1 h to dissolve and remove strontium carbonate. Washing with pure water was thereafter repeated, a part of the resultant cake was sampled and dried, and X-ray diffraction and X-ray fluorescence measurement were thereafter performed. The results are shown in Table 1.

Subsequently, a hydrochloric acid aqueous solution having a pH of 3.0 was added to the slurry, and isobutyltrimethoxysilane was added at 5.0% by mass with respect to the solid content of the slurry, followed by stirring for 10 h. Thereafter, neutralization was performed with a sodium hydroxide aqueous solution, followed by filtration with Nutsche and washing with pure water. The obtained cake was dried to obtain strontium titanate A-2. Physical properties are shown in Table 1.

Production Example of Strontium Titanate A-3

A hydrous titanium oxide slurry obtained by hydrolyzing a titanyl sulfate aqueous solution was washed with an alkaline aqueous solution until the electric conductivity of the supernatant liquid reached 50 μS/cm to reduce the amount of impurities and purify the slurry. Next, hydrochloric acid was added to the hydrous titanium oxide slurry to adjust the pH to 0.7 and obtain a titania sol dispersion.

A 1.2-fold molar amount of a strontium chloride aqueous solution was added to 2.0 mol (in terms of titanium oxide) of the titania sol dispersion, and the dispersion was placed in a reaction vessel and purged with nitrogen gas. Further, pure water was added so as to obtain a titanium oxide concentration of 1.0 mol/L.

Next, after stirring and mixing and heating to 85° C., 800 mL of a 5N sodium hydroxide aqueous solution was added over 20 min while applying ultrasonic vibrations, and the reaction was thereafter carried out for 20 min. Pure water at 5° C. was added to the slurry after the reaction, the slurry was rapidly cooled to not more than 30° C., and the supernatant was then removed. Further, a hydrochloric acid aqueous solution having a pH of 5.0 was added to the slurry, followed by stirring for 1 h to dissolve and remove strontium carbonate. Washing with pure water was thereafter repeated, a part of the resultant cake was sampled and dried, and X-ray diffraction and X-ray fluorescence measurement were thereafter performed. The results are shown in Table 1.

Subsequently, a hydrochloric acid aqueous solution having a pH of 3.0 was added to the slurry, and isobutyltrimethoxysilane was added at 30.0% by mass with respect to the solid content of the slurry, followed by stirring for 10 h. Thereafter, neutralization was performed with a sodium hydroxide aqueous solution, followed by filtration with Nutsche and washing with pure water. The obtained cake was dried to obtain strontium titanate A-3. Physical properties are shown in Table 1.

Production Example of Strontium Titanate A-4

Strontium titanate A-4 was obtained in the same manner as strontium titanate A-3, except that 4.0% by mass of n-octyltriethoxysilane was used instead of isobutyltrimethoxysilane. Physical properties are shown in Table 1.

Production Example of Strontium Titanate A-5

Strontium titanate A-5 was obtained in the same manner as strontium titanate A-4, except that the amount of n-octyltriethoxysilane added was changed to 2.0% by mass. Physical properties are shown in Table 1.

Production Example of Strontium Titanate A-6

A hydrous titanium oxide slurry obtained by hydrolyzing a titanyl sulfate aqueous solution was washed with an alkaline aqueous solution until the electric conductivity of the supernatant liquid reached 70 μS/cm to reduce the amount of impurities and purify the slurry. Next, hydrochloric acid was added to the hydrous titanium oxide slurry to adjust the pH to 0.7 and obtain a titania sol dispersion.

A 1.1-fold molar amount of a strontium chloride aqueous solution was added to 1.8 mol (in terms of titanium oxide) of the titania sol dispersion, and the dispersion was placed in a reaction vessel and purged with nitrogen gas. Further, pure water was added so as to obtain a titanium oxide concentration of 0.9 mol/L.

Next, after stirring and mixing and heating to 85° C., 576 mL of a 5N sodium hydroxide aqueous solution was added over 5 min while applying ultrasonic vibrations, and the reaction was thereafter carried out for 20 min. Pure water at 5° C. was added to the slurry after the reaction, the slurry was rapidly cooled to not more than 30° C., and the supernatant was then removed. Further, a hydrochloric acid aqueous solution having a pH of 5.0 was added to the slurry, followed by stirring for 1 h to dissolve and remove strontium carbonate. Washing with pure water was thereafter repeated, a part of the resultant cake was sampled and dried, and X-ray diffraction and X-ray fluorescence measurement were thereafter performed. The results are shown in Table 1.

Subsequently, a hydrochloric acid aqueous solution having a pH of 3.0 was added to the slurry, and n-octyltriethoxysilane was added at 2.0% by mass with respect to the solid content of the slurry, followed by stirring for 10 h. Thereafter, neutralization was performed with a sodium hydroxide aqueous solution, followed by filtration with Nutsche and washing with pure water. The obtained cake was dried to obtain strontium titanate A-6. Physical properties are shown in Table 1.

Production Example of Strontium Titanate A-7

A hydrous titanium oxide slurry obtained by hydrolyzing a titanyl sulfate aqueous solution was washed with an alkaline aqueous solution until the electric conductivity of the supernatant liquid reached 70 μS/cm to reduce the amount of impurities and purify the slurry. Next, hydrochloric acid was added to the hydrous titanium oxide slurry to adjust the pH to 0.7 and obtain a titania sol dispersion.

A 1.1-fold molar amount of a strontium chloride aqueous solution was added to 1.8 mol (in terms of titanium oxide) of the titania sol dispersion, and the dispersion was placed in a reaction vessel and purged with nitrogen gas. Further, pure water was added so as to obtain a titanium oxide concentration of 0.9 mol/L.

Next, after stirring and mixing and heating to 80° C., 792 mL of a 5N sodium hydroxide aqueous solution was added over 40 min while applying ultrasonic vibrations, and the reaction was thereafter carried out for 20 min. The slurry after the reaction was gradually cooled for 1 h to not more than 30° C., and the supernatant was then removed. Further, a hydrochloric acid aqueous solution having a pH of 5.0 was added to the slurry, followed by stirring for 1 h to dissolve and remove strontium carbonate. Washing with pure water was thereafter repeated, a part of the resultant cake was sampled and dried, and X-ray diffraction and X-ray fluorescence measurement were thereafter performed. The results are shown in Table 1.

Subsequently, a hydrochloric acid aqueous solution having a pH of 3.0 was added to the slurry, and n-octyltriethoxysilane was added at 2.0% by mass with respect to the solid content of the slurry, followed by stirring for 10 h. Thereafter, neutralization was performed with a sodium hydroxide aqueous solution, followed by filtration with Nutsche and washing with pure water. The obtained cake was dried to obtain strontium titanate A-7. Physical properties are shown in Table 1.

Production Example of Strontium Titanate A-8

A hydrous titanium oxide slurry obtained by hydrolyzing a titanyl sulfate aqueous solution was washed with an alkaline aqueous solution until the electric conductivity of the supernatant liquid reached 100 μS/cm to reduce the amount of impurities and purify the slurry. Next, hydrochloric acid was added to the hydrous titanium oxide slurry to adjust the pH to 0.7 and obtain a titania sol dispersion.

A 1.1-fold molar amount of a strontium chloride aqueous solution was added to 1.4 mol (in terms of titanium oxide) of the titania sol dispersion, and the dispersion was placed in a reaction vessel and purged with nitrogen gas. Further, pure water was added so as to obtain a titanium oxide concentration of 0.7 mol/L.

Next, after stirring and mixing and heating to 80° C., 1000 mL of a 3N sodium hydroxide aqueous solution was added over 40 min while applying ultrasonic vibrations, and the reaction was thereafter carried out for 20 min. The slurry after the reaction was gradually cooled for 1 h to not more than 30° C., and the supernatant was then removed. Further, a hydrochloric acid aqueous solution having a pH of 5.0 was added to the slurry, followed by stirring for 1 h to dissolve and remove strontium carbonate. Washing with pure water was thereafter repeated, a part of the resultant cake was sampled and dried, and X-ray diffraction and X-ray fluorescence measurement were thereafter performed. The results are shown in Table 1.

Subsequently, a hydrochloric acid aqueous solution having a pH of 3.0 was added to the slurry, and n-octyltriethoxysilane was added at 2.0% by mass with respect to the solid content of the slurry, followed by stirring for 10 h. Thereafter, neutralization was performed with a sodium hydroxide aqueous solution, followed by filtration with Nutsche and washing with pure water. The obtained cake was dried to obtain strontium titanate A-8. Physical properties are shown in Table 1.

Production Example of Strontium Titanate A-9

A hydrous titanium oxide slurry obtained by hydrolyzing a titanyl sulfate aqueous solution was washed with an alkaline aqueous solution until the electric conductivity of the supernatant liquid reached 100 μS/cm to reduce the amount of impurities and purify the slurry. Next, hydrochloric acid was added to the hydrous titanium oxide slurry to adjust the pH to 0.7 and obtain a titania sol dispersion.

A 1.1-fold molar amount of a strontium chloride aqueous solution was added to 1.0 mol (in terms of titanium oxide) of the titania sol dispersion, and the dispersion was placed in a reaction vessel and purged with nitrogen gas. Further, pure water was added so as to obtain a titanium oxide concentration of 0.5 mol/L.

Next, after stirring and mixing and heating to 70° C., 1100 mL of a 2N sodium hydroxide aqueous solution was added over 40 min while applying ultrasonic vibrations, and the reaction was thereafter carried out for 20 min. The slurry after the reaction was gradually cooled for 1 h to not more than 30° C., and the supernatant was then removed. Further, a hydrochloric acid aqueous solution having a pH of 5.0 was added to the slurry, followed by stirring for 1 h to dissolve and remove strontium carbonate. Washing with pure water was thereafter repeated, a part of the resultant cake was sampled and dried, and X-ray diffraction and X-ray fluorescence measurement were thereafter performed. The results are shown in Table 1.

Subsequently, a hydrochloric acid aqueous solution having a pH of 3.0 was added to the slurry, and n-octyltriethoxysilane was added at 2.0% by mass with respect to the solid content of the slurry, followed by stirring for 10 h. Thereafter, neutralization was performed with a sodium hydroxide aqueous solution, followed by filtration with Nutsche and washing with pure water. The obtained cake was dried to obtain strontium titanate A-9. Physical properties are shown in Table 1.

Production Example of Strontium Titanate A-10

A hydrous titanium oxide slurry obtained by hydrolyzing a titanyl sulfate aqueous solution was washed with an alkaline aqueous solution until the electric conductivity of the supernatant liquid reached 100 μS/cm to reduce the amount of impurities and purify the slurry. Next, hydrochloric acid was added to the hydrous titanium oxide slurry to adjust the pH to 0.7 and obtain a titania sol dispersion.

A 1.1-fold molar amount of a strontium chloride aqueous solution was added to 1.0 mol (in terms of titanium oxide) of the titania sol dispersion, and the dispersion was placed in a reaction vessel and purged with nitrogen gas. Further, pure water was added so as to obtain a titanium oxide concentration of 0.5 mol/L.

Next, after stirring and mixing and heating to 70° C., 1200 mL of a 2N sodium hydroxide aqueous solution was added over 240 min, and the reaction was thereafter carried out for 20 min. The slurry after the reaction was gradually cooled for 1 h to not more than 30° C., and the supernatant was then removed. Further, a hydrochloric acid aqueous solution having a pH of 5.0 was added to the slurry, followed by stirring for 1 h to dissolve and remove strontium carbonate. Washing with pure water and drying were thereafter performed to obtain inorganic fine particles (a). The half width of the inorganic fine particle (a) was 0.15. Further, the inorganic fine particles (a) were placed together with 4 mm alumina balls in an automatic discharge ball mill (manufactured by Eishin Co., Ltd.) and stirred for 200 h. Thereafter, the alumina balls were removed and cleaned, and after drying, the obtained inorganic fine particles were subjected to X-ray diffraction and X-ray fluorescence measurement. Physical properties are shown in Table 1.

Next, the inorganic fine particles were placed in a closed-type high-speed stirrer and stirred while purging with nitrogen. A treatment agent obtained by 6.5-fold dilution of dimethyl silicone oil taken at 4% by mass with respect to the solid content of the slurry with hexane was sprayed inside the stirrer. After spraying the entire amount of the treatment agent, the interior of the stirrer was heated to 350° C. while stirring, and stirring was performed for 3 h. The internal temperature of the stirrer was returned to room temperature under stirring, and the mixture was taken out and thereafter pulverized with a pin mill to obtain strontium titanate A-10. Physical properties are shown in Table 1.

Production Example of Strontium Titanate A-11

A hydrous titanium oxide slurry obtained by hydrolyzing a titanyl sulfate aqueous solution was washed with an alkaline aqueous solution until the electric conductivity of the supernatant liquid reached 100 μS/cm to reduce the amount of impurities and purify the slurry. Next, hydrochloric acid was added to the hydrous titanium oxide slurry to adjust the pH to 0.7 and obtain a titania sol dispersion.

A 1.0-fold molar amount of a strontium chloride aqueous solution was added to 1.0 mol (in terms of titanium oxide) of the titania sol dispersion, and the dispersion was placed in a reaction vessel and purged with nitrogen gas. Further, pure water was added so as to obtain a titanium oxide concentration of 0.5 mol/L.

Next, after stirring and mixing and heating to 70° C., 1100 mL of a 2N sodium hydroxide aqueous solution was added over 40 min while applying ultrasonic vibrations, and the reaction was thereafter carried out for 20 min. The slurry after the reaction was gradually cooled for 1 h to not more than 30° C., and the supernatant was then removed. Washing with pure water was thereafter repeated, a part of the resultant cake was sampled and dried, and X-ray diffraction and X-ray fluorescence measurement were thereafter performed. The results are shown in Table 1.

Subsequently, a hydrochloric acid aqueous solution having a pH of 3.0 was added to the slurry, and n-octyltriethoxysilane was added at 1.0% by mass with respect to the solid content of the slurry, followed by stirring for 10 h. Thereafter, neutralization was performed with a sodium hydroxide aqueous solution, followed by filtration with Nutsche and washing with pure water. The obtained cake was dried to obtain strontium titanate A-11. Physical properties are shown in Table 1.

Production Example of Strontium Titanate A-12

A hydrous titanium oxide slurry obtained by hydrolyzing a titanyl sulfate aqueous solution was washed with an alkaline aqueous solution until the electric conductivity of the supernatant liquid reached 100 μS/cm to reduce the amount of impurities and purify the slurry. Next, hydrochloric acid was added to the hydrous titanium oxide slurry to adjust the pH to 0.7 and obtain a titania sol dispersion.

A 1.0-fold molar amount of a strontium chloride aqueous solution was added to 0.6 mol (in terms of titanium oxide) of the titania sol dispersion, and the dispersion was placed in a reaction vessel and purged with nitrogen gas. Further, pure water was added so as to obtain a titanium oxide concentration of 0.3 mol/L.

Next, after stirring and mixing and heating to 70° C., 750 mL of a 2N sodium hydroxide aqueous solution was added over 120 min, and the reaction was thereafter carried out for 20 min. The slurry after the reaction was gradually cooled for 1 h to not more than 30° C., and the supernatant was then removed. The slurry was then washed with pure water and dried, and X-ray diffraction and X-ray fluorescence measurement of the obtained inorganic fine particles were thereafter performed. The results are shown in Table 1.

Next, the inorganic fine particles were placed in a closed-type high-speed stirrer and stirred while purging with nitrogen. A treatment agent obtained by 6.5-fold dilution of dimethyl silicone oil taken at 2% by mass with respect to the solid content of the slurry with hexane was sprayed inside the stirrer. After spraying the entire amount of the treatment agent, the interior of the stirrer was heated to 350° C. while stirring, and stirring was performed for 3 h. The internal temperature of the stirrer was returned to room temperature under stirring, and the mixture was taken out and thereafter pulverized with a pin mill to obtain strontium titanate A-12. Physical properties are shown in Table 1.

Production Example of Strontium Titanate A-13

A hydrous titanium oxide slurry obtained by hydrolyzing a titanyl sulfate aqueous solution was washed with an alkaline aqueous solution until the electric conductivity of the supernatant liquid reached 200 μS/cm to reduce the amount of impurities and purify the slurry. Next, hydrochloric acid was added to the hydrous titanium oxide slurry to adjust the pH to 0.7 and obtain a titania sol dispersion.

A 1.0-fold molar amount of a strontium chloride aqueous solution was added to 0.6 mol (in terms of titanium oxide) of the titania sol dispersion, and the dispersion was placed in a reaction vessel and purged with nitrogen gas. Further, 0.05 mol of aluminum sulfate was added and pure water was thereafter added so as to obtain a titanium oxide concentration of 0.3 mol/L.

Next, after stirring and mixing and heating to 70° C., 450 mL of a 2N sodium hydroxide aqueous solution was added over 5 min, and the reaction was thereafter carried out for 20 min. Pure water at 5° C. was added to the slurry after the reaction, the slurry was rapidly cooled to not more than 30° C., and the supernatant was then removed. The slurry was then washed with pure water and dried, and X-ray diffraction and X-ray fluorescence measurement of the obtained inorganic fine particles were thereafter performed. The results are shown in Table 1.

Next, the inorganic fine particles were placed in a closed-type high-speed stirrer and stirred while purging with nitrogen. A treatment agent obtained by 6.5-fold dilution of dimethyl silicone oil taken at 2% by mass with respect to the solid content of the slurry with hexane was sprayed inside the stirrer. After spraying the entire amount of the treatment agent, the interior of the stirrer was heated to 350° C. while stirring, and stirring was performed for 3 h. The internal temperature of the stirrer was returned to room temperature under stirring, and the mixture was taken out and thereafter pulverized with a pin mill to obtain strontium titanate A-13. Physical properties are shown in Table 1.

The strontium titanates A-1 to A-13 have a maximum peak (a) at a diffraction angle (2θ) of at least 32.00 deg and not more than 32.40 deg in CuKα characteristic X-ray diffraction.

TABLE 1

| Strontium titanate No. | Number average particle diameter (nm) | half width of maximum peak (a) (deg) | (lx)/(la) | Total content of SrO and $TiO_2$ (% by mass) | Moisture adsorption amount (mg/g) |
|---|---|---|---|---|---|
| A-1 | 35 | 0.33 | 0.006 | 98.5 | 15 |
| A-2 | 10 | 0.40 | 0.008 | 98.5 | 20 |
| A-3 | 50 | 0.28 | 0.008 | 98.4 | 1 |
| A-4 | 50 | 0.28 | 0.008 | 98.4 | 25 |
| A-5 | 50 | 0.28 | 0.008 | 98.4 | 40 |
| A-6 | 50 | 0.50 | 0.010 | 98.2 | 40 |
| A-7 | 50 | 0.23 | 0.010 | 98.2 | 40 |
| A-8 | 70 | 0.23 | 0.010 | 98.0 | 40 |
| A-9 | 95 | 0.23 | 0.010 | 98.0 | 40 |
| A-10 | 95 | 0.23 | 0.010 | 98.0 | 40 |
| A-11 | 95 | 0.23 | 0.013 | 98.0 | 45 |
| A-12 | 100 | 0.18 | 0.013 | 98.0 | 45 |
| A-13 | 110 | 0.55 | 0.016 | 96.4 | 47 |

Production Example of Binder Resin A-1

Bisphenol A ethylene oxide (2.2 mol adduct): 60.0 mol parts

Bisphenol A propylene oxide (2.2 mol adduct): 40.0 mol parts

Terephthalic acid: 100.0 mol parts

A total of 100 parts of the monomers constituting the polyester unit was placed in a 5 L autoclave. A reflux condenser, a moisture separator, an $N_2$ gas introducing tube, a thermometer and a stirrer were attached, and a polycondensation reaction was carried out at 230° C. while introducing $N_2$ gas into the autoclave. After completion of the reaction, the product was taken out of the container, cooled and pulverized to obtain a binder resin A-1.

Example A-1

Production Example of Toner A-1

Binder resin A-1: 100 parts

Fischer-Tropsch wax: 5 parts (melting point 105° C.)

Magnetic iron oxide particles: 90 parts (number average particle diameter 0.20 μm, Hc (coercive force)=10 kA/m, σs (saturation magnetization)=83 $Am^2/kg$, σr (remanent magnetization)=13 $Am^2/kg$)

Aluminum compound of 3,5-di-tert-butylsalicylic acid: 1 part

The above materials were premixed with a Henschel mixer and melt-kneaded with a twin-screw kneading extruder.

The obtained kneaded product was cooled, roughly pulverized with a hammer mill, and pulverized with a jet mill, the obtained finely pulverized powder was classified using a multi-division classifier utilizing the Coanda effect, and negative triboelectric-charging toner particles having a weight average particle diameter (D4) of 6.8 μm were obtained. The Tg of the toner particle was 60° C. To 100 parts of the toner particles, 1 part of strontium titanate A-1 and 1.0 part of hydrophobic silica fine powder (specific surface area determined by nitrogen adsorption measured by BET method was 140 $m^2/g$) were externally added and mixed with a Henschel mixer.

Regarding the external addition and mixing, in order to control the flowability of the toner, the cold water temperature and the cold water flow rate in the cold water jacket attached to the processing apparatus were adjusted, while monitoring the temperature inside the tank of the mixer, to adjust the temperature inside the tank of the mixer to 45° C. and control the adhesion state of the external additive. Subsequent sieving with a mesh having an opening of 150 μm produced a toner A-1. Physical properties of toner A-1 are shown in Table 2.

The evaluation was carried out by modifying the process speed of a commercially available digital copying machine (image RUNNER 4051, manufactured by Canon Inc.) to 252 mm/s. CS-680 (68.0 $g/m^2$ paper, A4) (marketed by Canon Marketing Japan Inc.) was used as the evaluation paper. Further, an image with a print percentage of 5% was used as an output image in the durability test.

Evaluation of Sleeve Ghost in Low-Temperature and Low-Humidity Environment

A sleeve ghost was evaluated in the following manner in a low-temperature and low-humidity (15° C., 10% RH) environment.

A full-surface halftone image was sent in the same job on the 1000-th sheet after passing through 999 continuous test charts each constituted by a vertical band of solid black and solid white outside the vertical band such as shown in FIG. 1.

Figure 2:
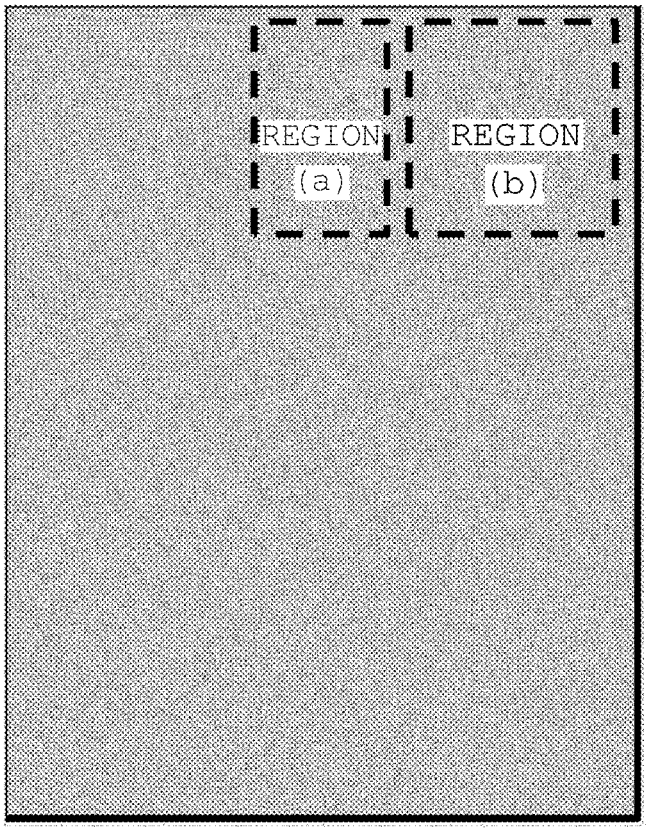
FIG. 2 is an example of an image for evaluating a sleeve ghost.

On the halftone image, the image density of a region (a) where the vertical band of solid black had passed and a region (b) where solid white had passed in FIG. 2 was measured, and the sleeve ghost was evaluated based on the difference in density. The regions (a) and (b) are the ranges of the first turn of the sleeve.

The image density was measured using an X-Rite color reflection densitometer (manufactured by X-Rite, Incorporated.; X-rite 500 Series).

A: the difference in density between the region (a) and the region (b) is less than 0.02;

B: the difference in density between the region (a) and the region (b) is at least 0.02 and less than 0.04;

C: the difference in density between the region (a) and the region (b) is at least 0.04 and less than 0.06;

D: the difference in density between the region (a) and the region (b) is at least 0.06 and less than 0.10.

Evaluation of Sleeve Ghost in High-Temperature and High-Humidity Environment

A sleeve ghost was evaluated in the following manner in a high-temperature and high-humidity (32.5° C., 80% RH) environment. After performing a continuous feeding test of up to 100,000 images with a print percentage of 5%, a full-surface halftone image was sent in the same job on the 1000-th sheet after passing through 999 continuous test charts each constituted by a vertical band of solid black and solid white outside the vertical band such as shown in FIG. 1.

On the halftone image, the image density of a region (a) where the vertical band of solid black had passed and a region (b) where solid white had passed in FIG. 2 was measured, and the sleeve ghost was evaluated based on the difference in density. The regions (a) and (b) are the ranges of the first turn of the sleeve.

The image density was measured using an X-Rite color reflection densitometer (manufactured by X-Rite, Incorporated.; X-rite 500 Series).

A: the difference in density between the region (a) and the region (b) is less than 0.02;

B: the difference in density between the region (a) and the region (b) is at least 0.02 and less than 0.04;

C: the difference in density between the region (a) and the region (b) is at least 0.04 and less than 0.06;

D: the difference in density between the region (a) and the region (b) is at least 0.06 and less than 0.10.

Evaluation of Dot Reproducibility

Evaluation of dot reproducibility was carried out by printing one halftone image of isolated one dot on A4 after outputting 100,000 sheets under a high-temperature and high-humidity (32.5° ° C., 80% RH) environment. Using a digital microscope VHX-500 (lens-wide-range zoom lens VH-Z 100 manufactured by Keyence Corporation), the area of 1000 dots was measured. The number average (S) of the dot area and the standard deviation (σ) of the dot area were calculated, and the dot reproducibility index was calculated by the following equation.

$$\text{Dot Reproducibility Index } (I) = \sigma / S \times 100$$

The smaller the dot reproducibility index (I), the better the dot reproducibility.

A: I is less than 2.0;

B: I is at least 2.0 and less than 3.0;

C: I is at least 3.0 and less than 5.0;

D: I is at least 5.0 and less than 7.0.

Fine Line Reproducibility

Evaluation of fine line reproducibility was performed by outputting images on 100,000 sheets under a high-temperature and high-humidity (32.5°, 80% RH) environment, and then printing an image (print area percentage: 4%) in which a lattice pattern with a line width of 3 pixels was printed on the entire surface of A4 paper. The fine line reproducibility was evaluated according to the following evaluation criteria. The line width of 3 pixels is theoretically 127 μm. The line width of the image was measured with a microscope VK-8500 (manufactured by Keyence Corporation). The line width was measured by choosing five points at random, and when the average value of three points excluding the minimum value and the maximum value was taken as d (μm), the following L was defined as the fine line reproducibility index.

$$L\ (\mu m) = |127 - d|$$

L is defined as the difference between the theoretical line width of 127 μm and the line width d on the outputted image. Since d can be larger or smaller than 127, it is defined as the absolute value of the difference. The smaller L indicates better fine line reproducibility.

Evaluation Criteria

A: L is at least 0 μm and less than 5 μm;

B: L is at least 5 μm and less than 10 μm;

C: L is at least 10 μm and less than 15 μm;

D: L is at least 15 μm and less than 20 μm.

Image Density

An original image in which five solid black patches of 20 mm square were arranged in a development area was used for the image to be evaluated. A continuous paper feeding test was performed up to 100,000 images with a print percentage of 5% under a normal-temperature and normal-humidity (23° C., 55% RH) environment. After outputting 100,000 sheets, the original image in which five solid black patches of 20 mm square were arranged in the development area was outputted, and the average of the five points was taken as the image density.

The image density was measured using an X-Rite color reflection densitometer (manufactured by X-Rite, Incorporated.; X-rite 500 Series).

A: image density at least 1.45;

B: image density at least 1.40 and less than 1.45.

Fogging

In evaluating fogging, a continuous paper feeding test was performed up to 100,000 images with a print percentage of 5% under a normal-temperature and normal-humidity (23° C., 55% RH) environment, and a solid white image was then evaluated according to the following criteria. The measurement was performed using a reflectometer (Reflectometer Model TC-6DS, manufactured by Tokyo Denshoku Co., Ltd.), the worst value of the white background reflection density after image formation was denoted by Ds, the reflection average density of the transfer material before image formation was denoted by Dr, and Dr—Ds was used as a fogging amount to evaluate fogging. Therefore, the smaller the numerical value is, the less fogging occurs.

Evaluation Criteria

A: fogging is less than 1.0;

B: fogging is at least 1.0 and less than 2.0.

The toner A-1 of Example A-1 had a rank A in each of the above evaluation items.

Production Examples of Toners A-2 to A-11

Toners A-2 to A-11 were obtained in the same manner as in Production Example of Toner A-1, except that the weight average particle diameter of the toner, the kind and addition amount of strontium titanate, the addition amount of hydrophobic silica fine powder, and the temperature inside the tank of the mixer when toner particles, strontium titanate and hydrophobic silica fine powder were externally added were changed as shown in Table 2.

Examples A-2 to A-11

The toners A-2 to A-11 were evaluated in the same manner as in Example A-1. The evaluation results are shown in Table 3.

TABLE 2

| Toner No. | Weight average particle diameter (μm) | Strontium titanate No. | Temperature inside the tank (° C.) | Tg-(temperature inside the tank) (° C.) | Addition amount of strontium titanate (parts) | Addition amount of hydrophobic silica fine powder (parts) | Et (mJ) |
|---|---|---|---|---|---|---|---|
| A-1 | 6.8 | A-1 | 45 | −15 | 1.0 | 1.0 | 400 |
| A-2 | 7.5 | A-1 | 45 | −15 | 0.8 | 1.0 | 500 |
| A-3 | 6.1 | A-2 | 42 | −18 | 1.5 | 1.0 | 200 |
| A-4 | 6.1 | A-3 | 47 | −13 | 0.1 | 1.0 | 1000 |
| A-5 | 6.1 | A-4 | 47 | −13 | 0.1 | 1.0 | 1000 |
| A-6 | 6.1 | A-5 | 47 | −13 | 0.1 | 1.0 | 1000 |
| A-7 | 6.1 | A-6 | 40 | −20 | 2.0 | 2.0 | 100 |
| A-8 | 6.1 | A-7 | 50 | −10 | 0.05 | 0.5 | 2000 |
| A-9 | 8.0 | A-8 | 50 | −10 | 0.05 | 0.5 | 2000 |

TABLE 2-continued

| Toner No. | Weight average particle diameter (μm) | Strontium titanate No. | Temperature inside the tank (° C.) | Tg-(temperature inside the tank) (° C.) | Addition amount of strontium titanate (parts) | Addition amount of hydrophobic silica fine powder (parts) | Et (mJ) |
|---|---|---|---|---|---|---|---|
| A-10 | 5.5 | A-9 | 50 | −10 | 0.05 | 0.5 | 2000 |
| A-11 | 9.0 | A-10 | 50 | −10 | 0.04 | 0.5 | 2000 |

TABLE 3

| Example No. | Toner No. | Sleeve ghost (low-temperature and low-humidity) Rank | Difference in density | Sleeve ghost (high-temperature and high humidity) Rank | Difference in density | Fine line reproducibility index Rank | L | Dot reproducibility index Rank | (I) | Image density Rank | Image density | Fogging Rank | Fogging |
|---|---|---|---|---|---|---|---|---|---|---|---|---|---|
| A-1 | A-1 | A | 0.01 | A | 0.01 | A | 2 | A | 1.4 | A | 1.48 | A | 0.3 |
| A-2 | A-2 | A | 0.01 | A | 0.01 | A | 2 | A | 1.4 | A | 1.48 | A | 0.3 |
| A-3 | A-3 | A | 0.01 | A | 0.01 | A | 2 | A | 1.4 | A | 1.48 | A | 0.3 |
| A-4 | A-4 | B | 0.02 | A | 0.01 | A | 4 | A | 1.6 | A | 1.48 | A | 0.3 |
| A-5 | A-5 | B | 0.02 | A | 0.01 | A | 4 | A | 1.6 | A | 1.48 | A | 0.3 |
| A-6 | A-6 | B | 0.03 | B | 0.02 | A | 4 | A | 1.6 | A | 1.46 | A | 0.5 |
| A-7 | A-7 | B | 0.03 | B | 0.02 | B | 7 | B | 2.3 | A | 1.46 | A | 0.5 |
| A-8 | A-8 | B | 0.03 | B | 0.02 | B | 7 | B | 2.3 | B | 1.43 | B | 1.1 |
| A-9 | A-9 | C | 0.04 | B | 0.03 | B | 7 | B | 2.8 | B | 1.43 | B | 1.1 |
| A-10 | A-10 | C | 0.04 | B | 0.03 | C | 10 | C | 3.7 | B | 1.43 | B | 1.1 |
| A-11 | A-11 | C | 0.04 | C | 0.04 | C | 10 | C | 4.2 | B | 1.43 | B | 1.1 |

Comparative Examples A-1 to A-3

Production Example of Toners A-12 to A-14

Toners A-12 to A-14 were obtained in the same manner as in Production Example of Toner A-1, except that the weight average particle diameter of the toner, the kind and addition amount of strontium titanate, and the addition amount of hydrophobic silica fine powder were changed as shown in Table 4.

TABLE 4

| Toner No. | Weight average particle diameter (μm) | Strontium titanate No. | Temperature inside the tank (° C.) | Tg-(temperature inside the tank) (° C.) | Addition amount of strontium titanate (parts) | Addition amount of hydrophobic silica fine powder (parts) | Et (mJ) |
|---|---|---|---|---|---|---|---|
| A-12 | 9.0 | A-11 | 50 | −10 | 0.04 | 0.5 | 2000 |
| A-13 | 9.0 | A-12 | 55 | −5 | 0.02 | 0.4 | 2100 |
| A-14 | 9.0 | A-13 | 35 | −25 | 2.1 | 2.2 | 90 |

Toners A-12 to A-14 were evaluated in the same manner as in Example A-1. Evaluation results are shown in Table 5.

TABLE 5

| Comparative Example No. | Toner No. | Sleeve ghost (low-temperature and low-humidity) Rank | Difference in density | Sleeve ghost (high-temperature and high humidity) Rank | Difference in density | Fine line repro-ducibility index Rank | L | Dot repro-ducibility index Rank | (I) | Image density Rank | Image density | Fogging Rank | Fogging |
|---|---|---|---|---|---|---|---|---|---|---|---|---|---|
| A 1 | A 12 | C | 0.05 | D | 0.07 | C | 10 | C | 4.4 | B | 1.40 | B | 1.1 |
| A 2 | A 13 | C | 0.05 | D | 0.07 | D | 16 | D | 5.3 | B | 1.40 | B | 1.1 |
| A 3 | A 14 | D | 0.07 | D | 0.09 | D | 16 | D | 6.2 | B | 1.40 | B | 1.1 |

Next, the second aspect of the present invention will be described with reference to examples.

Production Example of Inorganic Fine Particles B-1

A total of 1500 parts of strontium carbonate and 800 parts of titanium oxide were wet-mixed for 8 h in a ball mill, followed by filtration and drying, and the mixture was molded under a pressure of 5 kg/cm$^2$ and calcined for 8 h at 1300° C. The calcined product was mechanically pulverized to obtain inorganic fine particles B-1 having a number average particle diameter of primary particles of 1000 nm.

Production Example of Inorganic Fine Particles B-2 to B-7

Inorganic fine particles B-2 to B-7 were obtained in the same manner as the inorganic fine particles B-1, except that the pulverization conditions were adjusted so as to obtain a desired particle diameter. The respective number average particle diameters are shown in Table 6.

TABLE 6

| Inorganic fine particles B No. | Number average particle diameter nm |
|---|---|
| B 1 | 1000 |
| B 2 | 600 |
| B 3 | 1500 |
| B 4 | 500 |
| B 5 | 2000 |
| B 6 | 400 |
| B 7 | 2200 |

Production Example of Binder Resin B-1

Propylene oxide adduct of bisphenol A: 34.0 mol % (average addition mole number: 2.2 mol)

Ethylene oxide adduct of bisphenol A: 19.5 mol % (average addition mole number: 2.2 mol)

Isophthalic acid: 23.5 mol %

N-dodecenylsuccinic acid: 13.5 mol %

Trimellitic acid: 9.5 mol %

To the abovementioned monomers, dibutyltin oxide was added in an amount of 0.03 part based on 100 parts of the total acid component, and the reaction was conducted while stirring for 6 h at 220° C. under a nitrogen flow to obtain a binder resin B-1. The resin had a softening point of 135° C. and a Tg of 65° C.

Example B-1

Production Example of Toner B-1

Binder resin B-1:100 parts

Fischer-Tropsch wax: 5 parts (melting point 105° C.)

Magnetic iron oxide particles: 90 parts (number average particle diameter 0.20 μm, Hc (coercive force)=10 kA/m, σs (saturation magnetization)=83 Am$^2$/kg, σr (remanent magnetization)=13 Am$^2$/kg)

Aluminum compound of 3,5-di-tert-butylsalicylic acid: 1 part

The above materials were premixed with a Henschel mixer and melt-kneaded with a twin-screw kneading extruder.

The obtained kneaded product was cooled, roughly pulverized with a hammer mill, and pulverized with a jet mill, the obtained finely pulverized powder was classified using a multi-division classifier utilizing the Coanda effect, and negative triboelectric-charging toner particles having a weight average particle diameter (D4) of 6.8 μm were obtained. To 100 parts of the toner particles, 1.0 part of strontium titanate A-1 as the inorganic fine particles A, 3.0 parts of the inorganic fine particles B-1, and 1.0 part of hydrophobic silica fine powder (specific surface area determined by nitrogen adsorption measured by BET method was 140 m$^2$/g) were externally added and mixed. The mixture was sieved with a mesh having an opening of 150 μm to obtain a toner B-1. Physical properties of toner B-1 are shown in Table 7.

The evaluation was carried out by modifying the process speed of a commercially available digital copying machine (image RUNNER 4051, manufactured by Canon Inc.) to 252 mm/s.

Evaluation of Sleeve Ghost in Low-Temperature and Low-Humidity Environment (LL)

Evaluation was carried out in the same manner as in the evaluation of the sleeve ghost in the low-temperature and low-humidity environment in the first aspect.

Evaluation of Sleeve Ghost in High-Temperature and High-Humidity Environment (HH)

Evaluation was carried out in the same manner as in the evaluation of the sleeve ghost in the high-temperature and high-humidity environment in the first aspect.

Evaluation of White Streaks

White streaks were evaluated under a low-temperature and low-humidity (15° C., 10% RH) environment in the following manner. A total of 100,000 A4 images with a print percentage of 70% were continuously outputted. The presence or absence of white streaks in the image during paper feed and the presence or absence of streaks due to aggregates on the sleeve after completion of durable paper feed were checked and evaluated in the following manner.

A: no occurrence of white streaks was observed on the image and the sleeve through paper feed durability;

B: white streaks could not be seen on the image, but slight streaks were seen on the sleeve;

C: white streaks could not be seen on the image, but streaks were seen on the sleeve;

D: white streaks occurred on the image.

Evaluation of Cleaning Defects

Evaluation of defective cleaning was carried out in the following manner. The pressing pressure of the cleaning member to the photosensitive member was changed to 0.52 N (0.53 kgf), and 100,000 sheets of A4 text charts with a print percentage of 5% were outputted under a low-temperature and low-humidity (15° C./10% RH) environment. The occurrence of vertical streaks caused by cleaning defects was checked and the state of contamination of the charging member with toner or external additive was checked after completion of durable paper feed. The evaluation was based on the following criteria.

A: no image defect caused by cleaning defect was observed through paper feed durability, and the contamination state of the charging member after completion of durable paper feed was also satisfactory;

B: although no image defect caused by cleaning defect was observed through paper feed durability, light contamination was observed in the charging member after completion of durable paper feed;

C: although no image defect caused by cleaning defect was observed through paper feed durability, contamination was observed in the charging member after completion of durable paper feed;

D: there was an image defect caused by cleaning defect in paper feed durability.

The toner B-1 of Example B-1 had a rank A in each of the above evaluation items.

Examples B-2 to B-16

Production Examples of Toners B-2 to B-16

Toners B-2 to B-16 were obtained in the same manner as in Production Example of Toner B-1, except that the weight average particle diameter of the toner and the types and addition amounts of the inorganic fine particles A and the inorganic fine particles B were changed as shown in Table 7. Further, these toners were evaluated in the same manner as toner B-1. The evaluation results are shown in Table 8.

TABLE 7

| | | | Inorganic fine particles A | | Inorganic fine particles B | | |
|---|---|---|---|---|---|---|---|
| Example No. | Toner No. | D4 μm | Strontium titanate No. | Addition amount (parts) | No. | Addition amount (parts) | Mass ratio A/B |
| B-1 | B-1 | 6.8 | A-1 | 1.0 | B-1 | 3.0 | 1.0/3.0 |
| B-2 | B-2 | 6.8 | A-1 | 0.1 | B-1 | 1.8 | 1.0/18.0 |
| B-3 | B-3 | 6.0 | A-1 | 0.1 | B-2 | 2.0 | 1.0/20.0 |
| B-4 | B-4 | 6.0 | A-1 | 1.5 | B-3 | 1.5 | 1.0/1.0 |
| B-5 | B-5 | 6.0 | A-1 | 2.0 | B-3 | 1.5 | 1.0/0.75 |
| B-6 | B-6 | 6.0 | A-2 | 0.05 | B-3 | 1.5 | 1.0/30.0 |
| B-7 | B-7 | 4.0 | A-3 | 2.1 | B-3 | 1.5 | 1.0/0.71 |
| B-8 | B-8 | 4.0 | A-4 | 0.04 | B-3 | 1.5 | 1.0/37.5 |
| B-9 | B-9 | 9.0 | A-4 | 0.04 | B-4 | 1.5 | 1.0/37.5 |
| B-10 | B-10 | 9.0 | A-4 | 0.04 | B-5 | 1.5 | 1.0/37.5 |
| B-11 | B-11 | 9.0 | A-5 | 0.04 | B-5 | 1.5 | 1.0/37.5 |
| B-12 | B-12 | 9.0 | A-6 | 0.04 | B-5 | 1.5 | 1.0/37.5 |
| B-13 | B-13 | 9.0 | A-7 | 0.04 | B-5 | 1.5 | 1.0/37.5 |
| B-14 | B-14 | 9.0 | A-8 | 0.04 | B-5 | 1.5 | 1.0/37.5 |
| B-15 | B-15 | 9.0 | A-9 | 0.04 | B-5 | 1.5 | 1.0/37.5 |
| B-16 | B-16 | 9.0 | A-10 | 0.04 | B-5 | 1.5 | 1.0/37.5 |

TABLE 8

| | White | Cleaning | Sleeve ghost (low-temperature and lot-humidity) | | Sleeve ghost (high-temperature and high-humidity) | |
|---|---|---|---|---|---|---|
| Example No. | streaks Rank | defect Rank | Rank | Difference in density | Rank | Difference in density |
| B-1 | A | A | A | 0.01 | A | 0.01 |
| B-2 | A | A | A | 0.01 | A | 0.01 |
| B-3 | A | B | A | 0.01 | A | 0.01 |
| B-4 | A | B | A | 0.01 | A | 0.01 |
| B-5 | B | B | A | 0.01 | A | 0.01 |
| B-6 | B | B | A | 0.01 | A | 0.01 |
| B-7 | B | B | B | 0.02 | A | 0.01 |
| B-8 | B | B | B | 0.02 | A | 0.01 |
| B-9 | B | C | B | 0.02 | A | 0.01 |
| B-10 | B | C | B | 0.02 | A | 0.01 |
| B-11 | B | C | B | 0.03 | B | 0.02 |
| B-12 | B | C | C | 0.04 | B | 0.02 |
| B-13 | B | C | C | 0.04 | B | 0.02 |
| B-14 | B | C | C | 0.04 | C | 0.04 |
| B-15 | C | C | C | 0.04 | C | 0.04 |
| B-16 | C | C | C | 0.04 | C | 0.04 |

Comparative Examples B-1 to B-4

Production Example of Toners B-17 to B-20

Toners B-17 to B-20 were obtained in the same manner as in Example B-1, except that the particle diameter of the toner particles and the types and addition amounts of the inorganic fine particles A and the inorganic fine particles B were changed as shown in Table 9. The toners B-17 to B-20 were evaluated by the same method as in Example B-1. Evaluation results are shown in Table 10.

TABLE 9

| Comparative | | | Inorganic fine particles A | | Inorganic fine particles B | | |
|---|---|---|---|---|---|---|---|
| Example No. | Toner No. | D4 μm | Strontium titanate No. | Addition amount (parts) | No. | Addition amount (parts) | Mass ratio A/B |
| B-1 | B-17 | 9.0 | A-9 | 0.04 | B-6 | 1.5 | 1.0/37.5 |
| B-2 | B-18 | 9.0 | A-11 | 0.04 | B-7 | 1.5 | 1.0/37.5 |
| B-3 | B-19 | 9.0 | A-12 | 0.04 | B-7 | 1.5 | 1.0/37.5 |
| B-4 | B-20 | 9.0 | A-13 | 0.04 | B-7 | 1.5 | 1.0/37.5 |

TABLE 10

| Comparative Example No. | White streaks Rank | Cleaning defect Rank | Sleeve ghost (low-temperature and lot-humidity) Rank | Sleeve ghost (low-temperature and lot-humidity) Difference in density | Sleeve ghost (high-temperature and high-humidity) Rank | Sleeve ghost (high-temperature and high-humidity) Difference in density |
|---|---|---|---|---|---|---|
| B-1 | C | D | C | 0.05 | C | 0.05 |
| B-2 | C | D | C | 0.05 | D | 0.07 |
| B-3 | D | D | D | 0.07 | D | 0.07 |
| B-4 | D | D | D | 0.09 | D | 0.09 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-35822, filed Feb. 28, 2017, and Japanese Patent Application No. 2018-12641, filed Jan. 29, 2018, which are hereby incorporated by reference herein in their entirety.

What is claimed is:

1. A toner comprising:

a toner particle; and strontium titanate, fine particle having a number average primary particle diameter of 10 to 95 nm;

the strontium titanate fine particle having a maximum peak (a) at a diffraction angle (2θ) of 32.00 to 32.40 deg in CuKα characteristic X-ray diffraction, a half width of the maximum peak (a) being 0.23 to 0.50 deg, wherein (Ix)/(Ia)≤0.010 where (Ia) is an intensity of the maximum peak (a) and (Ix) is a maximum peak intensity in a range of a diffraction angle (2θ) of 24.00 to 28.00 deg in CuKα characteristic X-ray diffraction of the strontium titanate fine particle, a total content of strontium oxide and titanium oxide is at least 98.0% by mass when all elements detected by X-ray fluorescence analysis of the strontium titanate fine particles are considered to be in the form of oxides and a total amount of all the oxides is taken as 100% by mass, and a sum total Et of a rotational torque and a vertical load is 100 to 2000 mJ in powder flowability analysis of the toner when a propeller-type blade is vertically introduced into a powder layer of the toner in a measurement container while being rotated at a periphery speed of the outermost edge portion thereof at 100 mm/sec, measurement is started from a position of 100 mm from a bottom surface of the powder layer, and the propeller-type blade is introduced to a position of 10 mm from the bottom surface.

2. The toner according to claim 1, wherein the content of the strontium titanate is 0.05 to 2.0 parts by mass with respect to 100 parts by mass of the toner particle.

3. The toner according to claim 1, wherein the strontium titanate is surface-treated with a silane coupling agent.

* * * * *